US009051634B2

(12) United States Patent
Morohoshi et al.

(10) Patent No.: US 9,051,634 B2
(45) Date of Patent: Jun. 9, 2015

(54) STEEL SHEET

(75) Inventors: Takashi Morohoshi, Tokyo (JP); Takashi Aramaki, Tokyo (JP); Masafumi Zeze, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/351,399

(22) PCT Filed: Jun. 28, 2012

(86) PCT No.: PCT/JP2012/066536
§ 371 (c)(1),
(2), (4) Date: Apr. 11, 2014

(87) PCT Pub. No.: WO2013/061652
PCT Pub. Date: May 2, 2013

(65) Prior Publication Data

US 2014/0241934 A1 Aug. 28, 2014

(30) Foreign Application Priority Data

Oct. 25, 2011 (JP) ..... 2011-234396

(51) Int. Cl.
*C22C 38/00* (2006.01)
*C22C 38/02* (2006.01)
(Continued)

(52) U.S. Cl.
CPC ..... *C22C 38/001* (2013.01); *C21D 9/46* (2013.01); *C21C 7/04* (2013.01); *C22C 38/00* (2013.01);
(Continued)

(58) Field of Classification Search
CPC .... C22C 38/00; C22C 38/001; C22C 38/002; C22C 38/005; C22C 38/02; C22C 38/04; C22C 38/06; C22C 38/20; C22C 38/22; C22C 38/24; C22C 38/28; C22C 38/32; C22C 38/50; C22C 38/54
USPC ..... 420/83, 84, 103, 104, 126, 128; 148/331, 333
See application file for complete search history.

(56) References Cited

U.S. PATENT DOCUMENTS 5,261,975 A * 11/1993 Sorstrom et al. ..... 148/334
5,985,053 A * 11/1999 Hara et al. ..... 148/333
(Continued)

FOREIGN PATENT DOCUMENTS

CN 1580312 2/2005
CN 101376948 3/2009
(Continued)

OTHER PUBLICATIONS

International Search Report dated Aug. 28, 2012 issued in corresponding PCT Application No. PCT/JP2012/066536 [with English Translation].
(Continued)

*Primary Examiner* — Helene Klemanski
(74) *Attorney, Agent, or Firm* — Kenyon & Kenyon LLP

(57) ABSTRACT

Disclosed is a steel sheet in which the amounts of respective elements in chemical components, which are represented by mass %, satisfy the following Expression 1 and Expression 2. In addition, the steel contains Ti-included-carbonitrides as inclusions, and the number density of the Ti-included-carbonitrides having a long side of 5 μm or more is 3 pieces/mm$^2$ or less.

$$0.3 \leq \{Ca/40.88+(REM/140)/2\}/(S/32.07) \quad \text{(Expression 1)}$$

$$Ca \leq 0.005-0.0035 \times C \quad \text{(Expression 2).}$$

5 Claims, 1 Drawing Sheet

(51) Int. Cl.

| | |
|---|---|
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C21D 9/46*** | (2006.01) |
| ***C22C 38/54*** | (2006.01) |
| ***C22C 38/32*** | (2006.01) |
| ***C22C 38/50*** | (2006.01) |
| *C21C 7/04* | (2006.01) |
| *C21D 8/02* | (2006.01) |

(52) U.S. Cl.

CPC ..... *C22C 38/28* (2013.01); *C22C 38/54* (2013.01); *C22C 38/002* (2013.01); *C22C 38/005* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/32* (2013.01); *C22C 38/50* (2013.01); *C21D 8/0226* (2013.01); *C21D 8/0236* (2013.01); *C21D 8/0263* (2013.01); *C21D 8/0273* (2013.01); *C21D 2211/004* (2013.01)

(56) References Cited

U.S. PATENT DOCUMENTS

| | | | | |
|---|---|---|---|---|
| 6,203,630 | B1 * | 3/2001 | Matsumura et al. | 420/126 |
| 2004/0187971 | A1 * | 9/2004 | Omura | 148/333 |
| 2005/0025658 | A1 | 2/2005 | Matsui et al. | |
| 2006/0016520 | A1 * | 1/2006 | Numata et al. | 420/84 |
| 2006/0157162 | A1 * | 7/2006 | Hirata et al. | 148/331 |
| 2010/0143179 | A1 * | 6/2010 | Sandstrom et al. | 420/84 |
| 2013/0084205 | A1 * | 4/2013 | Numata et al. | 420/84 |
| 2013/0153091 | A1 * | 6/2013 | Fujita et al. | 420/83 |
| 2014/0144556 | A1 * | 5/2014 | Zhang et al. | 148/541 |

FOREIGN PATENT DOCUMENTS

| | | | | |
|---|---|---|---|---|
| JP | 2000-265239 | | 9/2000 | |
| JP | 2005-068482 | | 3/2005 | |
| JP | 2008-081823 | | 4/2008 | |
| JP | 2011-068949 | | 4/2011 | |
| WO | WO 03083152 | A1 * | 10/2003 | C22C 38/00 |

OTHER PUBLICATIONS

Office Action dated Oct. 22, 2014 issued in corresponding Chinese Application No. 201280052054.1 [with English Translation].

* cited by examiner

STEEL SHEET

TECHNICAL FIELD

The present invention relates to a high carbon steel sheet, and more particularly, to a high carbon steel sheet for cold punching which is shaped into a product shape by cold punching. For example, this high carbon steel sheet may be used for production of a platelike component of steel (element) that is used for a belt-type CVT (Continuously Variable Transmission), a link plate of a band saw, a circular saw, or a chain, and the like.

This application is a national stage application of International Application No. PCT/JP/2012/066536, filed Jun. 28, 2012, which claims priority to Japanese Patent Application No. 2011-234396, filed on Oct. 25, 2011, the content of which is incorporated herein by reference.

BACKGROUND ART

The belt-type CVT of a vehicle includes a steel belt configured by attaching a plurality of a platelike component of steel (elements) to a continuous circular steel ring side by side, and a pair of pulleys having a variable groove width. In addition, the steel belt is wound between the pair of pulleys in an endless annular, and power transmission is performed from one pulley to the other pulley through the steel belt. The respective elements are disposed by being sandwiched between two bundles of steel rings. Power from an engine is input to one pulley, is transmitted to the other pulley through the steel belt, and is output. At that time, the effective diameter of each of the pulleys is made to vary by changing the groove width of each of the pulleys, and thus continuous gear change occurs.

Elements for the belt-type CVT are shaped into a product shape by cold-punching the steel sheet. Therefore, it is necessary for a material suitable for the elements to have high hardness, high wear resistance, and cold punching properties. As a material satisfying these demands, Patent Document 1 and Patent Document 2 suggest the following steel.

Patent Document 1 discloses steel which includes, by mass %, C: 0.1% to 0.7%, Cr: 0.1% to 2.0% and S: 0.030% or less, and which is subjected to a carburizing treatment (carburizing and quenching—tempering) after the punching. The steel is a low and medium carbon steel that is soft and thus the lifetime of a precision mold used for punching increases. As a result, the machining costs may be reduced. In addition, the steel secures the hardness necessary for a surface layer (a depth of 50 μm from a surface) by the carburizing treatment. Furthermore, the steel is lows and medium carbon steel, and thus toughness of a core of a carburized product may be maintained to be high. As a result, an impact value of the carburized product itself may be improved.

Patent Document 2 discloses high carbon steel which includes, by mass %, C: 0.70% to 1.20% and in which the particle size of carbides dispersed in a ferrite matrix is controlled. The steel has improved notch tensile elongation having a close relationship with punching workability, and thus the punching workability thereof is excellent. In addition, the steel further includes Ca, and thus morphology of MnS is controlled. As a result, the punching workability is further improved.

PRIOR ART DOCUMENT

Patent Document

[Patent Document 1] Japanese Unexamined Patent Application, First Publication No. 2005-068482

[Patent Document 2] Japanese unexamined Patent Application, First Publication No. 2000-265239

DISCLOSURE OF THE INVENTION

Problem that the Invention is to Solve

To correspond to power transmission of a relatively large size and high-power engine, there has been a demand for further improved toughness or fatigue properties of the elements. In addition, in a case in which gear change of the power transmission of the engine is rapidly performed, a large impact is applied to the elements of the CVT. In elements not having high toughness, there is a concern that cracking is introduced due to the impact, the cracking leads to fracture, and the CVT is ultimately fractured. Similarly, along with rotation of the steel belt, repetitive stress is applied to the elements of the CVT. In the elements not having excellent fatigue properties, there is a concern that cracking easily progresses and that the elements are prone to fractures. From these viewpoints, there has been a demand for further improvements in the toughness or fatigue properties of the steel used for the elements.

With regard to the above-described demand, the following problem for the toughness or the fatigue property is present in the above-described related art.

In the steel disclosed in Patent Document 1, in order for the impact value not to decrease, by mass %, the amount of S is limited to 0.030% or less and preferably 0.010% or less. However, with regard to the steel, the composition or morphology of the inclusions is not controlled, and thus MnS remains in the steel. Therefore, the steel may not be used under strict conditions.

MnS has a tendency to be elongated during rolling, and the length in a processing direction may be elongated to several hundreds of micrometers. Inclusions (hereinafter, referred to as A-type inclusions) that are elongated in the processing direction are particularly harmful from the viewpoint of toughness or fatigue properties of steel, and it is necessary to reduce the number of inclusions. MnS is generated mainly during solidification from molten steel. Particularly, by mass %, in carbon steel in which the amount of C is 0.5% or more, there is a tendency for coarse MnS to be generated at micro-segregation area between dendrite branches. The reason for this tendency is that in carbon steel including 0.5% or more of C, the primary crystal during solidification is γ (austenite) phase, and thus diffusion of Mn or S in a solid phase is delayed, and thus micro-segregation has a tendency to occur.

In a steel sheet for mechanical components for which high quality is in demand for toughness or fatigue properties, prevention of A-type inclusions is particularly important. However, in the steel disclosed in Patent Document 1, reduction countermeasure of MnS according to the amount of C is not particularly described.

On the other hand, in the steel disclosed in Patent Document 2, the shape of MnS is spheroidized by adding Ca, and thus the number of above A-type inclusions may be largely reduced. However, according to the examination of the present inventors, in the steel disclosed in Patent Document 2, the number of A-type inclusions is reduced, and a plurality of granular inclusions (hereinafter, referred to as B-type inclusions) which are discontinuously lined up in a group in a processing direction, or irregularly dispersed inclusions (hereinafter, referred to as C-type inclusions) remain in the steel. In addition, they have found that these inclusions serve as an origin point of fatigue fracture and thus the fatigue properties of the steel deteriorate. In addition, the steel disclosed in Patent Document 2 includes Ti. However, when coarse Ti-included-carbonitrides (C-type inclusions) are generated alone in the steel, there is a problem in that the inclusions have a tendency to serve as an origin point of fatigue fracture.

The invention as been made in consideration of the above-described problem. According to an aspect of the present invention, the invention provides a high carbon steel sheet which includes, by mass %, 0.5% to 0.8% of C, and has a strength (hardness), a wear resistance, and a cold punching workability that are suitable for production of elements. In addition, according to another aspect of the invention, the invention provides a steel sheet which achieves excellent toughness and fatigue properties by reducing the number of A-type inclusions, B-type inclusions, and C-type inclusions in steel, and preventing coarse Ti-included-carbonitrides from being generated. In addition, according to another aspect the invention, the invention provides a steel sheet that is excellent in production cost. In addition, strength mainly represents tensile strength. In addition, generally, tensile strength and hardness are characteristic values correlated with each other, and thus in the following description, strength also includes the meaning of hardness.

Means for Solving the Problems

The gist of the invention is as follows.

(1) According to an aspect of the invention, there is provided a steel sheet in which chemical components of steel include, by mass %: 0.5% to 0.8% of C; 0.15% to 0.60% of Si; 0.40% to 0.90% of Mn; 0.010% to 0.070% of Al; 0.001% to 0.010% of Ti; 0.30% to 0.70% of Cr; 0.0005% to 0.0030% of Ca; 0.0003% to 0.0050% of REM; 0.020% or less of P; 0.0070% or less of S; 0.0040% or less of O; and 0.0075% or less of N, the balance consisting Fe and unavoidable impurities. The amounts of the respective elements in the chemical components, which are represented by satisfy the following Expression 1 and Expression 2. The steel contains Ti-included-carbonitrides as an inclusion, and a number density of the Ti-included-carbonitrides having a long side of 5 μm or more is 3 pieces/mm$^2$ or less.

$$0.3 \leq \{Ca/40.88+(REM/140)/2\}(S/32.07) \quad \text{(Expression 1)}$$

$$Ca \leq 0.005-0.0035 \times C \quad \text{(Expression 2)}$$

(2) in the steel sheet according to (1), the chemical components may further include at least one selected from a group consisting of, by mass %, 0% to 0.05% of Cu, 0% to 0.05% of Nb, 0% to 0.05% of V, 0% to 0.05% of Mo, 0% to 0.05% of Ni, and 0% to 0.0050% of B.

(3) In the steel sheet according to (1) or (2), the steel may further include a composite inclusion including Al, Ca, O, S, and REM, and an inclusion in which the Ti-included-carbonitrides are attached to a surface of the composite inclusion.

(4) In the steel sheet according to (3), the amounts of the respective elements in the chemical components, which are represented by mass %, satisfy the following Expression 3.

$$18 \times (REM/140)-O/16 \geq 0 \quad \text{(Expression 3)}$$

(5) In the steel sheet according to (1) or (2), the amounts of the respective elements in the chemical components, which are represented by mass %, may satisfy the following Expression 4.

$$18 \times (REM/140)-O/16 \geq 0 \quad \text{(Expression 4)}$$

Advantage of the Invention

According to the above-described aspects of the invention, a steel sheet, which is excellent in strength (hardness), wear resistance, and cold punching workability, and which achieves excellent toughness and fatigue properties by reducing the number of A-type inclusions, B-type inclusions, and C-type inclusions in steel and by preventing coarse Ti-included-carbonitrides from being generated may be provided.

EMBODIMENTS OF THE INVENTION

Figure 1:
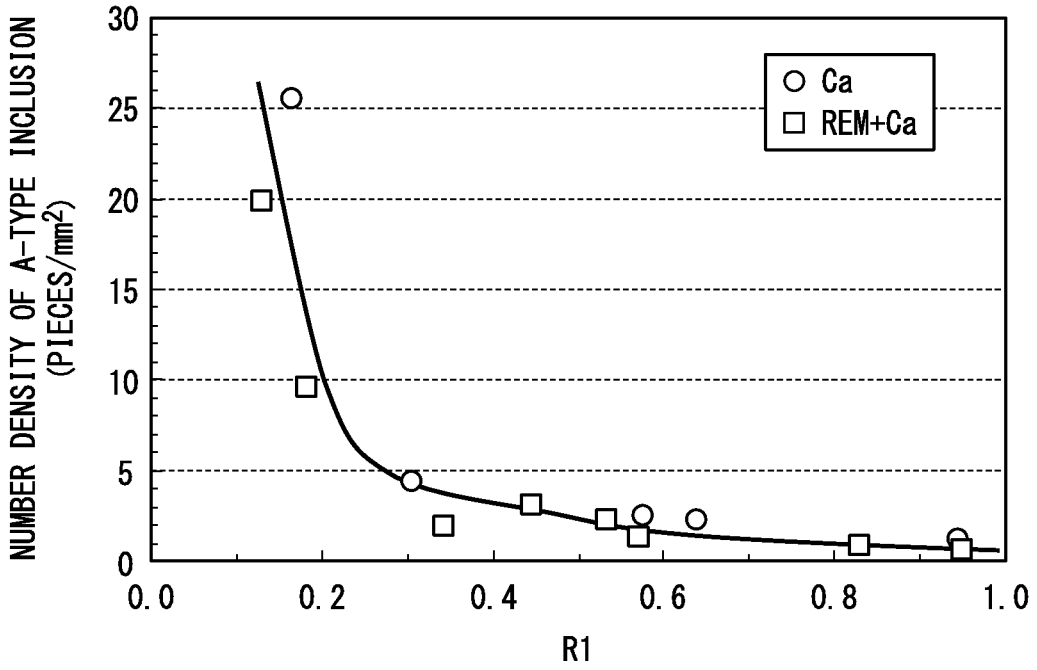
FIG. 1 is a graph illustrating a relationship between the sum of chemical equivalents of Ca and REM that are bonded to S, and the number density of A-type inclusions.

Hereinafter, a preferred embodiment of the invention will be described. However, the invention is not limited to the configuration disclosed in the embodiment, and various modifications may be made within a range not departing from the scope of the invention.

First, inclusions that are included in a steel sheet related to the embodiment will be described.

One of causes that deteriorate toughness or fatigue properties is non-metallic inclusions included in the steel sheet (hereinafter, referred to as inclusions). Examples of the inclusions include oxides, sulfides, and the like that are generated in molten steel or during solidification. The inclusions serve as an origin point of a crack when a stress is applied to steel. The size of the inclusions ranges from several micrometers to several hundreds of micrometers in a case of elongation by rolling. To secure and improve the toughness or fatigue properties of steel, it is preferable that the size of the inclusions in a steel sheet is small, and the number of the inclusion is small, that is, the cleanliness of a steel sheet is high.

The inclusions have various shapes, distribution states, and the like. Hereinafter the inclusions are classified into three kinds of inclusions according to the definition provided below.

A-type inclusions are inclusions viscously deformed by processing. An A-type inclusion is an individual inclusion which has high elongation property and an aspect ratio (major axis/minor axis) of 3.0 or more.

B-type inclusions are inclusions in which a granular inclusion is discontinuously lined up in a group in a processing direction. A B-type inclusion has a shape with a corner in many cases, low elongation property, and an aspect ratio (major axis/minor axis) of less than 3.0. In addition, three or more inclusions are aligned in a processing direction to form an inclusion group.

C-type inclusions are irregularly dispersed inclusions without viscous deformation. A C-type inclusion has an angular shape or a spherical shape, low elongation property, and an aspect ratio (major axis/minor axis) of less than 3.0. In addition, C-type inclusions are randomly distributed. In addition, Ti-included-carbonitrides having an angular shape are classified as C-type inclusions, and may be discriminated from other C-type inclusions based on shape and color tone.

In addition, in the steel sheet related to the embodiment, inclusions having a particle size (in the case of a spherical inclusion) or a long axis (in the case of a deformed inclusion) of 1 μm or more are only taken into consideration. Even when an inclusion having a particle size or major axis of less than 1 μm is included in steel, this inclusion has less effect on toughness or fatigue properties of steel, and is not taken into consideration. In addition, the major axis is defined as a line segment having the maximum length among line segments obtained by connecting respective vertexes not adjacent to each other in a cross-sectional contour of an inclusion on an observation plane. Similarly, the above-described minor axis is defined as a line segment having a minimum length among line segments obtained by connecting respective vertexes not adjacent to each other in a cross-sectional contour of an inclusion on an observation plane. In addition, a long side to be described later is defined as a line segment having the maximum length among line segments obtained by connecting respective vertexes adjacent to each other in a cross-sectional contour of an inclusion on an observation plane.

Ca or REM (Rare Earth Metal) is added to control the abundance of inclusions in steel or the shape thereof in the related art. In Japanese Unexamined Patent Application, First Publication No. 2011-68949, the present inventors have suggested a technology in which Ca and REM are added to a steel plate for structure which includes, by mass %, 0.08% to 0.22% of C to control an oxide (inclusion) generated in steel to a mixed phase of a high melting point phase and a low melting point phase, to prevent the oxide (inclusion) from being elongated during rolling, and to suppress occurrence of an erosion of a continuous casting nozzle or internal inclusion defects.

Furthermore, with respect to steel including 0.5% to 0.8% of C by mass %, the present inventors have examined conditions for reducing the above-described A-type inclusions, B-type inclusions, and C-type inclusions by adding Ca and REM. As a result, the present inventors have found the following conditions which allow simultaneous reduction in A-type inclusions, B-type inclusions, and C-type inclusions.

With Regard to A-Type Inclusions

The present inventors haze examined with respect to addition of Ca and REM to steel including, by mass %, 0.5% to 0.8% of C. As a result, the present inventors have found that the A-type inclusions in steel, particularly, MnS constituting A-type inclusions may be largely reduced when the amounts of elements in chemical components which are represented by mass % satisfy the following Expression I.

$$0.3 \leq \{Ca/40.88+(REM/140)/2\}(S/32.07) \quad \text{(Expression I)}$$

Hereinafter, an experiment based on the finding will be described.

Steel including chemical components in which the amount of C is 0.7% by mass %, and the amounts of S, Ca, and REM are variously changed is prepared by a vacuum furnace as an ingot of 50 kg. The composition of the ingot is shown in Table 1. The ingot is hot-rolled under conditions in which a finish rolling temperature is 890° C. to have a thickness of 0.5 mm, and then the resultant hot-rolled ingot is cooled by air cooling to obtain a hot-rolled steel sheet.

Inclusions in steel are observed by using hot-rolled steel sheet that is obtained. The observation is performed as follows. A cross-section which parallels with a rolling direction of the hot-rolled steel sheet and a sheet thickness direction is set as an observation plane, and the total of 60 visual fields are observed using an optical microscope at a magnification of 400 times (however, a magnification of 1,000 times in a case of measuring the shape of the inclusions in detail). Inclusions having a particle size (in a case of spherical inclusions) or a major axis (in a case of deformed inclusions) of 1 μm or more are observed in the respective observation visual fields, and these inclusions are classified into A-type inclusions, B-type inclusions, C-type inclusions, and Ti-included-carbonitrides (may be discriminated according to the shape and color thereof) having an angular shape. Then, the number density of the inclusions is measured. In addition, when a metallographic structure of the hot-rolled steel sheet is observed using a SEM (Scanning Electron Microscope) having a function of EPMA (Electron Probe Micro analysis) and EDX (Energy Dispersive X-ray Analysis), the Ti-included-carbonitrides, REM-included composite inclusions, MnS, CaO—$Al_2O_3$-based inclusions, and the like among the inclusions may be identified.

Furthermore, with regard to the hot-rolled steel sheet that is obtained, an impact value at room temperature is measured by Charpy test in order to evaluate toughness. In addition, a pulsating tensile testis performed in order to evaluate fatigue properties. In the pulsating tensile test, an S—N curve is created so as to obtain a fatigue limit.

From the above-described experiment, it is proved that the toughness, the fatigue properties, and the number density of the inclusion have a correlation. Specifically, it is proved that when the number density of the A-type inclusions in steel exceeds 5 pieces/$mm^2$, the toughness or the fatigue properties of the steel sheet rapidly deteriorate. In addition, it is proved that even when the total of the number density of B-type inclusions and C-type inclusions exceeds 5 pieces/$mm^2$, the toughness or fatigue properties of the steel sheet rapidly deteriorate. Furthermore, with regard to the Ti-included-carbonitrides that are the C-type inclusion, it is proven that when the number density of the coarse Ti-included-carbonitrides having a long side of 5 μm or more exceeds 3 pieces/$mm^2$, the toughness or the fatigue properties of the steel sheet rapidly deteriorate.

TABLE 1

| (mass %) | | | | | | | | | |
|---|---|---|---|---|---|---|---|---|---|
| C | Si | Mn | P | S | Al | Ti | Cr | Ca | REM |
| 0.7 | 0.35 | 0.6 | 0.015 | 0.003-0.005 | 0.03 | 0.01 | 0.4 | 0.0005-0.0035 | 0.001-0.005 |

It is assumed that Ca is bonded to S in steel to form CaS, and REM is bonded to S and O to form $REM_2O_2S$ (oxysulfide). When the atomic weight of S is 32.07, the atomic weight of Ca is 40.88, the atomic weight of REM is 140 as a representative value, and the amounts of respective elements in chemical components which are represented by mass % are used, the sum R1 of chemical equivalents of Ca and REM that are bonded to S may be expressed by the following expression.

$$R1=\{Ca/40.88+(REM/140)/2\}(S/32.07)$$

Therefore, the number density of A-type inclusions, which is measured in each hot-rolled steel sheet, is collected as R1 of each hot-rolled steel sheet. Results thereof are shown in FIG. 1. In FIG. 1, a circle mark represents results of steel that includes Ca and does not include REM (hereinafter, referred to as independent addition of Ca), and a square mark represents results of steel that includes Ca and also includes REM (hereinafter, referred to as composite addition of REM and Ca). In addition, in the case of the independent addition of Ca above R1 is calculated by assuming that the amount of REM is 0. From FIG. 1, it can be seen that the number density of A-type inclusions may be collected using R1 in both, the case of the independent addition of Ca and the case of the composite addition of REM and Ca.

Specifically, when the value of R1 is 0.3 or more, the number density of the A-type inclusion rapidly decreases, and thus the number density thereof becomes 5 pieces/$mm^2$ or less. As a result, the toughness or the fatigue property of the steel sheet is improved.

In addition, in the case of the independent addition of Ca, the major axis of the A-type inclusion in steel further increases compared to the case of the composite addition of REM and Ca. The reason for this increase is considered to be because in the case of the independent addition of Ca, a $CaO—Al_2O_3$-based low-melting-point oxide is generated, and this oxide is elongated during rolling. Accordingly, when also considering the major axis of the inclusion which has an adverse effect on characteristics of the steel sheet, the composite addition of REM and Ca is more preferable than the independent addition of Ca.

From the result, it can be seen that in the case of the composite addition of REM and Ca under the conditions satisfying Expression I, the number density of the A-type inclusions in steel may be preferably reduced to 5 pieces/$mm^2$ or less.

In addition, when the value of R1 is 1 as an average composition, one equivalent of Ca and REM that are bonded to S in steel are present in steel. However, actually, even when the value of R1 is 1, there is a concern that MnS may be generated at micro-segregation area between dendrite branches. When the value of R1 is 2 or more, the generation of MnS at the micro-segregation area may be preferably prevented. On the other hand, when a large amount of Ca or REM is added and thus the value of R1 exceeds 5, there is a tendency that coarse B-type or C-type inclusions having a major axis larger than 20 μm are generated. Accordingly, it is preferable that the value of R1 is 5 or less. That is, it is preferable that the upper limit of Expression I is 5 or less.

With Regard to B-Type Inclusions and C-Type Inclusions

As described above, the observation plane of the hot-rolled steel sheet is observed to measure the number density of B-type inclusions and C-type inclusions which have an aspect ratio (major axis/minor axis) of less than 3, and a particle size or major axis of 1 μm or more. As a result, it is found that in both, the case of the independent addition of Ca and the case of the composite addition of REM and Ca, the greater the amount of Ca, the further the number density of B-type inclusions and C-type inclusions increases. On the other hand, it is found that the amount of REM does not have a large effect on the number density of the inclusions.

Figure 2:
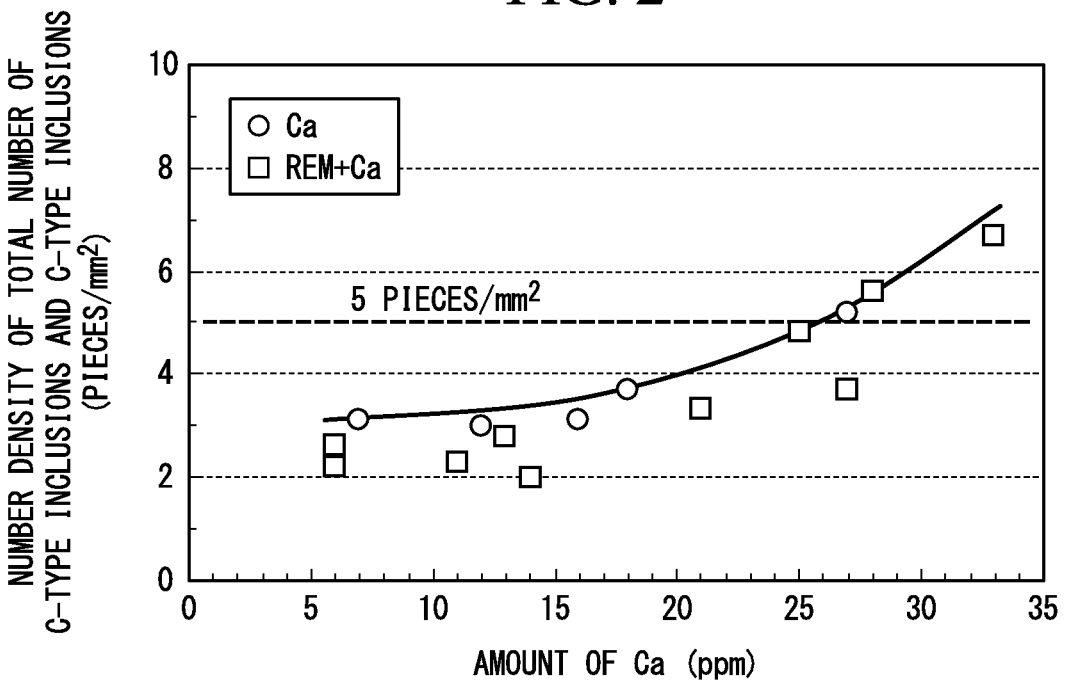
FIG. 2 is a graph illustrating a relationship between the amount of Ca in steel, and the number density of the total number of B-type inclusions and C-type inclusions.

FIG. 2 shows a relationship between the amount of Ca in steel, and a number density of the total of B-type inclusions and C-type inclusions in the case of the independent addition of Ca and in the case of the composite addition of REM and Ca. In addition, as described above, the amount of C in steel is 0.7% by mass %. In FIG. 2, a circle mark represents results of the independent addition of Ca, and a square mark represents results of the composite addition of REM and Ca. From FIG. 2, it can be seen that in both, the case of the independent addition of Ca, and the case of the composite addition of REM and Ca, the further the amount of Ca in steel increases, the further the number density of the total of the B-type inclusions and the C-type inclusions increases. In addition, when the amount of Ca in the case of the independent addition of Ca, and the amount of Ca in the case of the composite addition of REM and Ca are compared with each other in the same amount of Ca, the number density of the total of the B-type inclusions and the C-type inclusions becomes substantially the same value. That is, even when REM and Ca are compositely added to steel, it can be seen that REM has no effect on the number density of the total of B-type inclusions and C-type inclusions.

As described above, it is preferable to increase the amount of Ca and the amount of REM in steel within the above-described range so as to reduce the number of A-type inclusions. On the other hand, when an added amount of Ca is increased in order to reduce the number of A-type inclusions, as described above, there is a problem in that the number of B-type inclusions and C-type inclusions increases. That is, in the case of the independent addition of Ca, it can be said that it is difficult to reduce the number of A-type inclusions, B-type inclusions, and C-type inclusions at the same time. Conversely, in the case of the composite addition of REM and Ca the amount of Ca may be reduced while securing the chemical equivalent (the value of R1) of REM and Ca that are bonded to S. Accordingly, the composite addition is preferable. That is, in the case of the composite addition of REM and Ca, it is proved that the number density of A-type inclusions can be preferably reduced without increasing the number density of the total number of B-type inclusions and C-type inclusions.

The reason why the number density of the total number of B-type inclusions and C-type inclusions depends on the amount of Ca as described above is assumed to be as follows.

As described above, in the case of the independent addition of Ca, $CaO—Al_2O_3$-based inclusions is formed in steel. These inclusions are of a low-melting-point oxide, and thus the inclusions are present in molten steel in a liquid phase, and the inclusions are less likely to aggregate and be incorporated with each other in molten steel. That is, the inclusions are less likely to be floated and separated from molten steel. Accordingly, a plurality of inclusions having sizes of several micrometers remains in a slab in a dispersed manner, and thus the number density of the total number of B-type inclusions and C-type inclusions increases.

In addition, as described above, even in the case of the composite addition of REM and Ca, similarly, the number density of the total amount of B-type inclusions and C-type inclusions increases depending on the amount of Ca. In the case of the composite addition of REM and Ca, inclusions in which the amount of REM is high serve as a nucleus, and inclusions in which the amount of Ca is high are generated in the vicinity of the nucleus. That is, a surface of the inclusions in which the amount of Ca is high has a liquid phase in molten steel, and it is assumed that behavior of aggregation and incorporation thereof is similar to that of $CaO—Al_2O_3$-based inclusions that are generated during independent addition of Ca. Accordingly, a plurality of inclusions remains in the slab in a dispersed manner, and thus it is considered that the number density of the total amount of B-type inclusions and C-type inclusions increases.

In addition, when the particle size or the major axis of the $CaO—Al_2O_3$-based inclusion exceeds approximately 4 μm to 5 μm, this inclusion is elongated due to rolling, and becomes the A-type inclusion. On the other hand, the $CaO—Al_2O_3$-based inclusion having the particle size or the major axis of approximately less than 4 μm to 5 μm is hardly elongated by the rolling (the ratio of major axis/minor axis is less than 3), and thus this inclusion becomes the B-type inclusion or the C-type inclusion. In addition, inclusions which are generated in the case of the composite addition of REM and Ca and in which the amount of REM is high, are hardly elongated by the rolling. As a result, in all of the inclusions including inclusions which are generated in the vicinity of inclusions which are generated in the case of the composite addition of REM and Ca and in which the amount of Ca is high, elongation thereof due to rolling is prevented. That is, in the case of the composite addition of REM and Ca, even when relatively coarse inclusions are present, they are hardly elongated by the rolling, and thus the inclusions are mainly composed of B-type inclusions or C-type inclusions.

In addition, the present inventors have found that the number density of B-type inclusions and C-type inclusions is also affected by the amount of C in steel. Hereinafter, the effect of the amount of C in steel will be described.

An ingot in which the amount of C is 0.5% by mass % is prepared, and an experiment is performed by the same method as described above to measure the number density of B-type inclusions and C-type inclusions. In addition, experiment results of the steel in which the amount of C is 0.5% and above-described experiment results of the steel in which the amount of C is 0.7% are compared with each other.

From the result of comparison, it becomes clear that the number density of the total number of B-type inclusions and C-type inclusions has a correlation with the amount of Ca and the amount of C. That is, it is found that even when the amount of Ca is the same, the greater the amount of C, the further the number density of the total number of B-type inclusions and C-type inclusions increases. Specifically, it is found that it is necessary for the amounts of the respective element in the chemical components which are represented by mass % to be controlled be within a range expressed by the following Expression II so as to make the number density of the total number of B-type inclusions and C-type inclusions 5 pieces/$mm^2$ r or less.

$$Ca \leq 0.005 - 0.0035 \times C \quad \text{(Expression II)}$$

Expression II represents that it is necessary for the upper limit of the amount of Ca to be changed based on the amount of C. That is, as the amount of C increases, it is necessary for the upper limit of the amount of Ca to be reduced. In addition, although the lower limit of Expression II is not particularly limited, 0.0005 that is the lower limit of the amount of Ca by mass % becomes the lower limit of Expression II.

The reason why the further the amount of C increases, the further the number density of the total number of B-type inclusions and C-type inclusions increases is considered to be as follows. When the concentration of C in molten steel is high, the solidification temperature range from a liquidus line temperature to a solidus line temperature is broadened, and thus a dendrite structure is developed during solidification. That is, it is assumed that the dendrite structure is developed, and as a result, micro-segregation of a solute element between solid and liquid is promoted, and the inclusion has a tendency to be trapped between dendrite branches (the inclusions are less likely to be discharged to molten steel from a site between the dendrite branches). Accordingly, when the amount of C is large in steel where dendrite structure has a tendency to be developed during solidification, it is necessary to lower the upper limit of the amount of Ca in order for Expression II to be satisfied.

As described above, it can be seen that when an appropriate amount of REM and Ca is added in accordance with the amount of C, the amount of any of A-type inclusions, B-type inclusions and C-type inclusions may be effectively reduced.

In addition to this finding, the present inventors have also examined the morphology of the inclusions that have a tendency to serve as an origin point of fatigue fracture.

With Regard to Ti-Included-Carbonitrides

Generally, Ti is added to steel used for the elements so as to improve strength (hardness). In the case of Ti-included, Ti-included-carbonitrides, such as TiN is generated as inclusions in steel. The Ti-included-carbonitrides have high hardness, and have an angular shape. When the coarse Ti-included-carbonitrides are independently generated in steel, these carbonitrides have a tendency to serve as an origin point of fracture, and thus the toughness or fatigue properties may deteriorate.

As described above, from the examination of the relationship between the Ti-included-carbonitrides, toughness and the fatigue properties, it can be seen that when the number density of the Ti-included-carbonitrides having a long side length of 5 μm or more is 3 pieces/$mm^2$ or less, fractures are less likely to occur, and thus deterioration of toughness or fatigue properties may be prevented. Here, it is assumed that the Ti-included-carbonitrides include TiNb carbide, TiNb nitride, TiNb carbonitirde, and the like when Nb is included as an optional element, in addition to Ti carbide, Ti nitride, and Ti carbonitride.

It is preferable to reduce the amount of Ti so as to reduce the coarse Ti-included-carbonitrides. However, when the amount of Ti is reduced, it is difficult to preferably improve the strength (hardness) of steel. Therefore, the present inventors have examined conditions for reducing the amount of coarse Ti-included-carbonitrides. As a result, the present inventors have found that in the case of addition of REM or in the case of the composite addition of REM and Ca, a composite inclusion including Al, O, S, and REM (further including Ca in the case of adding REM and Ca) is generated in steel, and the Ti-included-carbonitrides have a tendency to be compositely precipitated preferentially on the REM-included composite inclusions, and thus these cases are preferable. When the Ti-included-carbonitrides are compositely precipitated preferentially on the REM-included composite inclusion, the Ti-included-carbonitrides that are independently generated in steel in an angular shape may be preferably reduced. That is, the number density of the coarse independent Ti-included-carbonitrides having a long side length of 5 μm or more may be preferably reduced to 3 pieces/$mm^2$ or less.

The Ti-included-carbonitrides that are compositely precipitated on the REM-included composite inclusion are less likely to serve as an origin point of fracture. The reason for this is considered to be as follows. When the Ti-included-carbonitrides are compositely precipitated on the REM-included composite inclusion, the size of the angular shaped portion of the Ti-included-carbonitrides is small. For example, since the Ti-included-carbonitrides have a cubic shape or a rectangular parallelepiped shape, in a case where the Ti-included-carbonitride is independently present in steel, 8 corners of the Ti-included-carbonitrides come into contact with a matrix. Conversely, in a case where the Ti-included-carbonitrides are compositely precipitated on the REM-included composite inclusion, and for example, the halt of the Ti-included-carbonitrides are come into contact with the matrix, only four sites of the Ti-included-carbonitrides are come into co act with the matrix. That is, the corner of the Ti-included-carbonitrides which is come into contact with the matrix is reduced from 8 sites to 4 sites. As a result, an origin point of the fracture is decreased.

In addition, the reason why the Ti-included-carbonitrides have a tendency to be compositely precipitated preferentially on the REM-included composite inclusions is assumed to be as follows. The Ti-included-carbonitrides are precipitated on a specific crystal plane of the REM composite inclusion, and thus the lattice matching properties between the crystal plane of the REM composite inclusion and the Ti-included-carbonitrides become satisfactory.

Next, the chemical components of the steel sheet related to the embodiment will be described.

First, with regard to basic components of the steel sheet related to the embodiment, a numerical value limitation range and the reason of imitation will be described. Here, % represents by mass %.

C: 0.5% to 0.8%

C (carbon) is an important element to secure strength (hardness) of the steel sheet. The strength of the steel sheet is secured by setting the amount of C to 0.5% or more. When the amount of C is less than 0.5%, hardenability decreases, and thus the strength necessary for a high-strength steel sheet for mechanical structure may not be obtained. On the other hand, when the amount of C exceeds 0.8%, a long time is necessary for a heat treatment to secure toughness or workability, and thus when the heat treatment is not performed for a long time, there is a concern that the toughness and fatigue properties of the steel sheet may deteriorate. Accordingly, the amount of C is controlled to be 0.5% to 0.8%. The lower limit of the amount of C is preferably set to 0.65%, and the upper limit of the amount of C is preferably set to 0.78%.

Si: 0.15% to 0.60%

Si (silicon) serves as deoxidizer. In addition. Si is an element that is effective for improving strength (hardness) of the steel sheet by increasing hardenability. When the amount of Si is less than 0.15%, the above-described addition effect may not be obtained. On the other hand, when the amount of Si exceeds 0.60%, there is a concern that deterioration surface properties of the steel sheet, which is caused by scale defects during hot rolling, may be caused. Accordingly, the amount of Si is controlled to 0.15% to 0.60%. The lower limit of the amount of Si is preferably set to 0.20%, and the upper limit of the amount of Si is preferably set to 0.55%.

Mn: 0.40% to 0.90%

Mn (manganese) is an element that serves as a deoxidizer. In addition, Mn is an element that is effective for improving the strength (hardness) of the steel sheet by increasing its hardenability. When the amount of Mn is less than 0.40%, the effect may not be sufficiently obtained. On the other hand, when the amount of Mn exceeds 0.90%, there is a concern that toughness of the steel sheet may deteriorate. Accordingly, the amount of Mn is controlled to 0.40% to 0.90%. The lower limit of the amount of Mn is preferably set to 0.50%, and the upper limit of the amount of Mn is preferably set to 0.75%.

Al: 0.010% to 0.070%

Al (aluminum) is an element that serves as an deoxidizer. In addition, Al is an element that is effective for increasing workability of the steel sheet by fixing N. When the amount of Al is less than 0.010%, the above-described addition effect may not be sufficiently obtained. When the deoxidization is not sufficient, an effect of reducing the number of A-type inclusions by REM or Ca is not sufficiently exhibited, and thus it is necessary for 0.010% or more of Al to be added. On the other hand, when the amount of Al exceeds 0.070%, the above-described addition effect is saturated, and a coarse inclusion increases, and thus there is a concern that toughness deteriorates or a surface defect has a tendency to occur. Accordingly, the amount of Al is controlled to be 0.010% to 0.070%. The lower limit of the amount of Al is preferably set to 0.020%, and the upper limit of the amount of Al is preferably set to 0.045%.

Ti: 0.001% to 0.010%

Ti (titanium) is an element that is effective for improving strength (hardness) of the steel sheet. When the amount of Ti is less than 0.001%, the above-described effect may not be sufficiently obtained. On the other hand, when the amount of Ti exceeds 0.010%, a large amount of TiN having an angular shape is generated, and thus there is a concern that toughness of the steel sheet may decrease. Accordingly, the amount of Ti is controlled to 0.001% to 0.010%. The upper limit of the amount of Ti is preferably set to 0.007%.

Cr: 0.30% to 0.70%

Cr (chromium) is an element that is effective for improving the strength (hardness) of the steel sheet by increasing its hardenability. When the amount of Cr is less than 0.30%, the above-described addition effect may not be sufficient. On the other hand, when the amount of Cr exceeds 0.70%, the addition cost increases, and the addition effect is saturated. Therefore, the amount of Cr is controlled to 0.30% to 0.70%. The lower limit of the amount of Cr is preferably set to 0.35%, and the upper limit of the amount of Cr is preferably set to 0.50%.

Ca: 0.0005% to 0.0030%

Ca (calcium) is an effective element for improving toughness and fatigue properties of the steel sheet by controlling the morphology of inclusions. When the amount of Ca is less than 0.0005%, the above-described effect may not be sufficiently obtained. In addition, as is the same case with independent addition of REM to be described later, there is a concern that nozzle clogging occurs during continuous casting and thus operation is not stable. In addition, there is a concern of high-specific-gravity inclusions being deposited on a lower surface side of a slab, and thus that toughness or fatigue properties of the steel sheet may deteriorate. On the other hand, when the amount of Ca exceeds 0.0030%, for example, coarse low-melting-point oxide inclusions, such as CaO—$Al_2O_3$-based inclusions, or inclusion such as CaS-based inclusions that are easily elongated during rolling have a tendency to be generated, and thus there is a concern that the toughness or fatigue properties of the steel sheet may deteriorate. Furthermore, erosion of nozzle refractory has a tendency to occur, and thus there is a concern that operation of continuous casting may not be stable. Accordingly the amount of Ca is controlled to 0.0005% to 0.0030%. The lower limit of the amount of Ca is preferably set to 0.0007%, and more preferably 0.0010%. The upper limit of the amount of Ca is preferably set to 0.0025%, and more preferably to 0.0020%.

Furthermore, it is necessary to control the upper limit of the amount of Ca in accordance with the amount of C. Specifically it is necessary for the amounts of the respective elements in the chemical components which are represented by mass % to be controlled within a range expressed by the following Expression III. In a case where the amount of Ca does not satisfy the following Expression III, the number density of the total number of B-type inclusions and C-type inclusions exceeds 5 pieces/$mm^2$.

$$Ca \leq 0.005 - 0.0035 \times C \quad \text{(Expression III)}$$

REM: 0.0003% to 0.0050%

REM (Rare Earth Metal) represents a rare earth element, and REM collectively represents 17 elements including scandium Sc (an atomic number is 21), yttrium Y (an atomic number is 39), and lanthanoids (15 elements from lanthanum having an atomic number of 57 to lutetium having an atomic number of 71). The steel sheet related to the embodiment includes at least one element selected from the elements. Generally, as REM, a selection is made among Ce (cerium), La (lanthanum), Nd (neodymium), Pr (praseodymium), and the like from the viewpoint of easy availability thereof. As an addition method, for example, a method of adding the elements to steel as a misch metal that is a mixture of these elements has been widely performed. In the steel sheet related to the embodiment, the total amount of these rare earth elements included in the steel sheet is set as the amount of REM.

REM is an element that is effective for improving toughness and fatigue properties of the steel sheet by controlling the morphology of inclusions therein. When the amount of REM is less than 0.0003%, the above-described effect may not be sufficiently obtained, and the same problem as the independent addition of Ca occurs. That is, the CaO—$Al_2O_3$-based inclusion or some of CaS is elongated due to rolling, and thus there is concern that deterioration of steel sheet characteristics may occur. In addition, since the composite inclusion including Al, Ca, O, S, and REM on which the Ti-included-carbonitrides have a tendency to be preferentially composed is less, Ti-included-carbonitrides that are independently generated in the steel sheet increases, and the toughness or fatigue properties have a tendency to deteriorate. On the other hand, when the amount of REM exceeds 0.0050%, nozzle clogging during continuous casting has a tendency to occur. In addition, since the number density of the REM-based inclusions (oxide or oxysulfide) that are generated is relatively increased, there is a concern that these inclusions are deposited on a lower surface side of a slab that is curved during continuous casting and an internal defect of a product Obtained by rolling the slab may be caused. In addition, there is a concern that the cold punching workability, toughness and fatigue properties of the steel sheet may be deteriorated. Accordingly, the amount of REM is controlled to 0.0003% to 0.0050%. The lower limit of the amount of REM is preferably set to 0.0005%, and more preferably 0.0010%. The upper limit of the amount of REM is preferably set to 0.0010%, and more preferably to 0.0030%.

Furthermore, it is necessary for the amounts of Ca and REM to be controlled depending on the amount of S. Specifically, it is necessary for the amounts of the respective elements in the chemical components which are represented by mass % to be controlled within a range expressed by the following Expression IV. When the amount of Ca, the amount of REM, and the amount of S do not satisfy the following Expression IV, the number density of the A-type inclusion exceeds 5 pieces/$mm^2$. In addition, when the right side value of the following Expression IV is 2 or more, the morphology of the inclusion may be further preferably controlled. In addition, the upper limit of the following Expression IV is not particularly limited. However, when the right side value of the following Expression IV exceeds 7, there is a tendency that coarse B-type or C-type inclusions having a maximum length exceeding 20 μm are generated. Accordingly, the upper limit of the following Expression IV is preferably 7.

$$0.3 \leq \{Ca/40.88+(REM/140)/2\}(S/32.07) \quad \text{(Expression IV)}$$

In addition, when (La/138.9+Ce/140.1+Nd/144.2) is used in place of (REM/140) in Expression IV, the amount of Ca and the amount of each REM may be controlled depending on the amount of S in a more accurate manner. In addition, the morphology of the inclusions may be preferably controlled.

The steel sheet related to the embodiment includes unavoidable impurities in addition to the above-described basic components. Here, the unavoidable impurities represent an auxiliary material such as scrap and elements such as P, S, O, N, Cd, Zn, Sb, W, Mg, Zr, As, Co, Sn, and Pb which are unavoidably included in the manufacturing processes. Among these, P, S, O, and N allow the above-described effect to preferably exhibit, and thus these elements are limited as follows. In addition, the amount of unavoidable impurities other than P, S, O, and N are preferably each limited to 0.01% or less. However, although these impurities are included in the amount of 0.01% or less, the above-described effect is not lost. Here, % represents mass %.

P: 0.020% or less

P is an element having a function of solid solution hardening. However, P is an impurity element that deteriorates the toughness of the steel sheet when being excessively included. Accordingly, the amount of P is limited to 0.020% or less. In addition, P is unavoidably included in steel, and thus it is not necessary to particularly limit the lower limit of the amount of P. The lower limit of the amount of P may be 0%. In addition, when considering current general refining (including secondary refining), the lower limit of the amount of P may be 0.005%.

S: 0.0070% or less

S (sulfur) is an impurity element that forms non-metallic inclusions, and deteriorates the workability and toughness of the steel sheet. Accordingly, the amount of S is limited to 0.0070% or less, and preferably to 0.005% or less. In addition. S is unavoidably included in steel, and thus the lower limit of the amount of S is not particularly limited. The lower limit of the amount of S may be 0%. In addition, when considering current general refining (including secondary refining), the lower limit of the amount of S may be 0.0003%.

O: 0.0040% or less

O (oxygen) is an impurity element that forms an oxide (non-metallic inclusion). The oxide condenses and coarsens, and deteriorates the toughness of the steel sheet. Accordingly, the amount of O is limited to 0.0040% or less. In addition, O is unavoidably included in steel, and thus it is not necessary to particularly limit the lower limit of the amount of O. The lower limit of the amount of O ray be 0%. In addition, considering current general refining (including secondary refining), the lower limit of the amount of O may be 0.0010%. The amount of O of the steel sheet related to the embodiment represents the total amount of O (the amount of T.O) which is the sum of all of the amounts of O including solid-solution O in steel, O present in inclusions, and the like.

Furthermore, the amount of O and the amount of REM are preferably controlled to be within the range expressed by the following Expression V by using the amounts of respective elements represented by mass %. When the following Expression V is satisfied, the number density of A-type inclusions is preferably further reduced. In addition, the upper limit of the following Expression V is not particularly limited. From the upper limit and the lower limit of the amount of O and the amount of REM, 0.000643 becomes the upper limit of the following Expression V.

$$18 \times (REM/140) - O/16 \geq 0 \quad \text{(Expression V)}$$

When the amount of O and the amount of REM are controlled, and thus when a mixed type of two kinds of composite oxides including $REM_2O_3.11Al_2O_3$ (a molar ratio of $REM_2O_3$ and $Al_2O_3$ is 1:11) and $REM_2O_3.Al_2O_3$ (a molar ratio of $REM_2O_3$ and $Al_2O_3$ is 1:1) are generated, the number of A-type inclusions is preferably further reduced. REM/140 in Expression V represents a molar ratio of REM, and O/16 represents a molar ratio of O. To generate the mixed type of $REM_2O_3.11Al_2O_3$ and $REM_2O_3.Al_2O_3$, it is preferable that the amount of REM be added to satisfy Expression V. When the amount of REM is small, and does not satisfy Expression V, there is a concern that a mixed type of $Al_2O_3$ and $REM_2O_3.11Al_2O_3$ may be generated. There is a concern that the $Al_2O_3$ reacts with CaO to generate CaO—$Al_2O_3$-based inclusion, and the CaO—$Al_2O_3$-based inclusion is elongated due to rolling.

N: 0.0075% or less

N (nitrogen) forms a nitride (non-metallic inclusion). N is an impurity element that decreases the toughness and fatigue properties of the steel sheet. Accordingly, the amount of N is limited to 0.075% or less. In addition, N is unavoidably included in steel, and thus it is not necessary to particularly limit the lower limit of the amount of N. The lower limit of the amount of N may be 0%. In addition, when considering current general refining (including secondary refining), the lower limit of the amount of N may be 0.0010%.

In the steel sheet related to the embodiment, the above-described basic components are controlled, and the balance includes Fe and unavoidable impurities. However the steel sheet related to the present embodiment, the following optional components may be further included in steel as necessary in addition to the basic components in substitution for a part of Fe included in the balance.

That is, a hot-rolled steel sheet related to the embodiment may further include at least one among Cu, Nb, V, Mo, Ni, and B as an optional component other than the above-described basic components and the unavoidable impurities. Hereafter, a numerical value limitation range of the optional component, and the reason of limitation will be described. % represents by mass %.

Cu: 0% to 0.05%

Cu (copper) is an optional element having an effect of improving the strength (hardness) of the steel sheet. Accordingly, Cu may be added to be within a range of 0% to 0.05% as necessary. In addition, when the lower limit of the amount of Cu is set to 0.01%, the above-described effect may be preferably obtained. On the other hand, when the amount of Cu exceeds 0.05%, there is a concern that hot working crack may occur during hot rolling due to liquid metal embrittlement (Cu crack). The lower limit of the amount of Cu is preferably set to 0.02%. The upper limit of the amount of is preferably set to 0.04%, Nb: 0% to 0.05%

Nb (niobium) forms carbonitrides. Nb is an optional element that is effective at preventing the coarsening of grains or improving toughness. Accordingly, Nb may be added to be within a range of 0% to 0.05% as necessary. In addition, when the lower limit of the amount of Nb is set to 0.01%, the above-described effect may be preferably obtained. On the other hand, when the amount of Nb exceeds 0.05%, coarse Nb carbonitrides precipitate and thus there is a concern that a decrease in the toughness of the steel sheet may be caused. The lower limit of the amount of Nb is preferably set to 0.02%. The upper limit of the amount of Nb is preferably set to 0.04%.

V: 0% to 0.05%

V (vanadium) forms carbonitrides similarly to Nb. V is an optional element that is effective at preventing coarsening of grains or improving toughness. Accordingly, V may be added to be within a range of 0% to 0.05% as necessary. In addition, when the lower limit of the amount of V is set to 0.01%, the above-described effect may be preferably obtained. On the other hand, when the amount of V exceeds 0.05%, coarse precipitates are generated and thus there is a concern that a decreases in toughness of the steel sheet may be caused. A preferable range is 0.02% to 0.04%. The lower limit of the amount of V is preferably set to 0.02%. The upper limit of the amount of V is preferably set to 0.04%.

Mo: 0% to 0.05%

Mo (molybdenum) is an optional element having an effect of improving strength (hardness) of the steel sheet through improvement of hardenability and improvement of temper softening resistance. Accordingly; Mo may be added to be within a range of 0% to 0.05% as necessary. In addition, when the lower limit of the amount of Mo is set to 0.01%, the above-described effect may be preferably obtained. On the other hand, when the amount of Mo exceeds 0.05% the addition cost increases, nevertheless the addition effect is saturated. Therefore, the upper limit is set to 0.05%. A preferable range is 0.01% to 0.05%.

Ni: 0% to 0.05%

Ni (nickel) is an optional element that is effective for improvement of strength (hardness) of the steel sheet and improvement of toughness thereof through improvement of hardenability. In addition, Ni is an optional element having an effect of preventing; liquid metal embrittlement (Cu crack) during addition of Cu. Accordingly, Ni may be added to be within a range of 0% to 0.05% as necessary. In addition, when the lower limit of the amount of Ni is set to 0.01%, the above-described effect may be preferably obtained. On the other hand, when the amount of Ni exceeds 0.05%, the addition cost increases, nevertheless the addition effect is saturated, and thus the upper limit is set to 0.05%. A preferable range is 0.02% to 0.05%.

B: 0% to 0.0050%

B (boron) is an optional element that is effective at improving the strength (hardness) of the steel sheet by improving hardenability. Accordingly, B may be added to be within a range of 0% to 0.0050% as necessary. In addition when the lower limit of the amount of B is set to 0.0010%, the above-described effect may be preferably obtained. On the other hand, when the amount of B exceeds 0.0050%, the B-type compound is generated and thus toughness of the steel sheet decreases. Therefore, the upper limit is set to 0.0050%. The lower limit of the amount of B is preferably set to 0.0020%. The upper limit of the amount of B is preferably set to 0.0040%.

Next, a metallographic structure of the steel sheet related to the embodiment will be described.

The metallographic structure of the steel sheet related to the embodiment is not particularly limited as long as the above-described morphology of the inclusions is satisfied and the above-described chemical components are satisfied. However, under conditions described in the following embodiment, a metallographic structure of a steel sheet that is produced by annealing after cold rolling mainly has ferrite+ spherical cementite. In addition, the spheroidizing ratio of cementite is 90% or more.

Number Density of Ti-included-carbonitrides Having Long Side of 5 μm or more: 3 pieces/$mm^2$ or less.

In the steel sheet related to the embodiment, a presence type of the Ti-included-carbonitride is specified so as to improve fatigue properties. Ti is added to the steel sheet related to the embodiment so as to improve strength (hardness). When Ti is included, Ti-included-carbonitrides such as TiN are generated in steel as inclusions. Since the Ti-included-carbonitrides have a high hardness and have an angular shape, when the coarse Ti-included-carbo nitrides are independently generated in steel, the Ti-included-carbonitrides have a tendency to serve as an origin point of fatigue fracture. Accordingly, to suppress deterioration of fatigue properties, the number density of the Ti-included-carbonitrides that do not compositely precipitate in combination with other inclusions, are independently present steel and have the long side of 5 μm or more is set to 3 pieces/$mm^2$. When the number density of the Ti-included-carbonitrides are 3 pieces/$mm^2$ or less, fatigue fractures are less likely to occur. In addition, as a method of controlling the number density of the Ti-included-carbonitrides that are independently present in steel and have a long side of 5 μm or more, as described above, it is preferable that the Ti-included-carbonitrides are allowed to preferentially compositely precipitate on the REM-included composite inclusion.

The steel sheet related to the embodiment described above.

(1) According to the embodiment, there is provided a steel sheet in which chemical components of steel include, by mass %: 0.5% to 0.8% of C; 0.15% to 0.60% of Si; 0.40% to 0.90% of Mn; 0.010% to 0.070% of Al; 0.001% to 0.010% of Ti; 0.30% to 0.70% of Cr; 0.0005% to 0.0030% of Ca; 0.0003% to 0.0050% of REM; 0.020% or less of P; 0.0070% or less of S; 0.0040% or less of 0; and 0.0075% or less of N, the balance composed of Fe and unavoidable impurities. The amounts of the respective elements the chemical components, which are represented by mass % satisfy the following Expression VI and Expression VII. The steel contains Ti-included-carbonitrides as inclusions, and the number density of the Ti-included-carbonitrides that are independently present in steel and have a, long side of 5 μm or more is 3 pieces/$mm^2$ or less.

$$0.3 \leq \{Ca/40.88 \pm (REM/140)/2\}/(S/32.07) \quad \text{(Expression VI)}$$

$$0.0005 \leq Ca \leq 0.005 - 0.0035 \times C \quad \text{(Expression VII)}$$

(2) In addition, the chemical components may further include at least one selected from a group consisting of, by mass %, 0% to 0.05% of Cu, 0% to 0.05% of Nb, 0% to 0.05% of V, 0% to 0.05% of Mo, 0% to 0.05% of Ni, and 0% to 0.0050% of B.

(3) In addition, the steel may further contain composite inclusions including Al, Ca, O, S, and REM and inclusions in which Ti-included-carbonitrides are attached to a surface of the composite inclusions.

(4) In addition, the amounts of the respective elements in the chemical components, which are represented by mass %, may satisfy the following Expression. VIE $$0 \leq 18 \times (REM/140) - O/16 \leq 0.000643 \quad \text{(Expression VIII)}$$

(5) In addition, the metallographic structure may mainly have ferrite+spherical cementite. In addition, a spheroidizing ratio of cementite may be 90% or more.

Next, a manufacturing method of the steel sheet related to the embodiment will be described.

Similarly to a general steel sheet, in the steel sheet related to the embodiment, for example, blast furnace hot metal is used as a raw material. Molten steel that is manufactured by performing converter refining or secondary refining is subjected to continuous casting so as to obtain a slab. Then, the slab is subjected to hot rolling, cold rolling, annealing and the like so as to obtain a steel sheet. At this time, after a decarbonizing treatment the converter, component adjustment of steel by secondary refining at a ladle and an inclusion control by addition of Ca and REM are performed. Furthermore, in addition to the blast furnace hot metal, molten steel obtained by melting steel scrap that is a raw material in an electric furnace may be used as a raw material.

Ca or REM is added after adjusting a component of an addition element such as Ti other than Ca and REM, and after securing a time for floating $Al_2O_3$ that is generated by Al deoxidation. When a large amount of $Al_2O_3$ remains in molten steel, Ca or REM is used for a reduction of $Al_2O_3$. Therefore, the ratio of Ca or REM which is used for fixation of S decreases, and thus generation of MnS may not be sufficiently prevented.

Since Ca has a high vapor pressure, Ca is preferably added as a Ca—Si alloy, Fe—Ca—Si alloy, a Ca—Ni alloy and the like so as to improve yield. For addition of these alloys, alloy wires of the respective alloys may be used. REM may be added in a type of a Fe—Si-REM alloy or a misch metal. The misch metal is a mixed material of rare earth elements. Specifically, the misch metal includes approximately 40% to 50% of Ce and approximately 20% to 40% of La in many cases. For example, a misch metal composed of 45% of Ce, 35% of La, 9% of Nd, 6% of Pr, and unavoidable impurities and the like is available.

An addition order of Ca and REM is not particularly limited. However, when Ca is added after REM is added, there is a tendency that the size of inclusions slightly becomes small, and thus the addition is preferably performed in this order.

After Al deoxidation, $Al_2O_3$ is generated and is partially clusters. However, when the addition of REM is performed earlier than the addition of Ca, a part of cluster is reduced and decomposed, and the size of cluster may be reduced. On the other hand, when the addition of Ca is performed earlier than the addition of REM, there is a concern that the composition of $Al_2O_3$ may be changed to CaO—$Al_2O_3$-based inclusion which has a low-melting-point, and the $Al_2O_3$ cluster may be converted into one coarse CaO—$Al_2O_3$-based inclusion. Accordingly, it is preferable that Ca be added after addition of REM.

Molten steel after refining is continuously cast order to obtain a slab. The slab is hot-rolled after heating, and then winding is performed at 450° C. to 660° C. After the hot-rolled steel sheet is subjected to pickling, retention of the hot-rolled steel sheet is performed at Ac1 transformation temperature or lower or at a two-phase region of 710° C. to 750° C. for 96 hours or less in accordance with target product hardness, whereby cementite is spheroidized (spheroidizing annealing of cementite). The Ac1 transformation temperature is a temperature at which transformation shrinkage is initiated at a thermal expansion test (at a heating rate of 5° C./s). The annealing may be omitted. In addition, the cold rolling is performed with a rolling reduction of 55% or less. However, the roiling reduction may be 0%, that is, the hot roiling may be omitted. Then, the above-described annealing, that is, annealing at Ac1 transformation temperature or lower or at a two-phase region of 710° C. to 750° C. for 96 hours or less is performed. Then, skin pass rolling with a rolling reduction of 4.0% or less may be performed as necessary to improve surface properties.

EXAMPLE 1

An effect of an aspect of the invention will be described in more detail with reference to examples. However, a condition in examples is only a conditional example adapted to confirm reproducibility and an effect of the invention, and the invention is not limited to the conditional example. The invention may adapt various conditions as long as the object of the invention may be accomplished without departing from the scope of the invention.

Blast furnace hot metal was used as a raw material. After a hot metal pretreatment and a decarbonizing treatment in a converter, component adjustment was performed by ladle refining, whereby 300 tons of molten steel having components shown in Tables 3 and 4 was melted. In the ladle refining, first, deoxidation was performed by adding Al. Then, the component of other elements such as Ti was adjusted, and then retention was performed for 5 minutes or more to allow $Al_2O_3$ generated by Al deoxidation so as to float. Then, REM was added, and retention was performed for 3 minutes in order for REM to be uniformly mixed. Then, Cu was added. As REM, misch metal was used, REM elements contained in the misch metal included 50% of Ce, 25% of La, and 10% of Nd, the balance composed of unavoidable impurities. Accordingly, the percentages of the respective REM elements included in a steel sheet that was obtained were substantially the same as values obtained by multiplying the amount of REM shown in Table 3 by the above-described percentages of the respective REM elements. Since Ca has a high vapor pressure, a Ca—Si alloy added to improve yield.

The molten steel after refining was subjected to continuous casting to obtain a slab having a thickness of 250 mm. Then, the slab was heated to 1,200° C., and was retained for one hour. Then, the slab was hot-rolled to have a sheet thickness of 4 mm, and then winding was performed at 450° C. to 660° C. The hot-rolled steel sheet was subjected to pickling. Then, under the conditions shown in Table 2, hot-rolled sheet annealing, cold rolling, and cold-rolled sheet annealing were performed, and skin pass rolling with a rolling reduction of 4.0% or less was performed as necessary. The metallographic structure of the hot-rolled sheet was ferrite+pearlite, or ferrite+bainite+pearlite. Since cementite was spheroidized by the annealing, the metallographic structure after the hot-rolled sheet annealing (after cold-rolled sheet annealing in the case of omitting hot-rolled sheet annealing) was ferrite+spheroidized cementite.

With respect to the cold-rolled steel sheet that was obtained, the composition of inclusions and deformation behavior (a ratio of major axis/minor axis after rolling; aspect ratio) were examined A cross-section parallel with a rolling direction and a sheet thickness direction was set as an observation plane, and 60 visual fields were observed using an optical microscope at a magnification of 400 times (however, a magnification of 1,000 times in a case of measuring the shape of the inclusions in detail). Inclusions having a particle size (in a case of spherical inclusions) or a major axis (in a case of deformed inclusions) of 1 μm or more were observed in the respective observation visual fields, and these inclusions were classified into the A-type inclusion, B-type inclusion, and C-type inclusion. In addition, the number density of these inclusions was measured. In addition, the number density of an inclusion that was angular Ti-included-carbonitride that independently precipitated in steel and had a long side larger than 5 μm was also measured. The Ti-included-carbonitrides be discriminated by an angular shape and a color thereof. In addition, the metallographic structure of the cold-rolled steel sheet may be observed using a SEM (Scanning Electron Microscope) having a function of EPMA (Electron Probe Micro analysis) and EDX (Energy Dispersive X-ray Analysis). In this case, included-carbonitride, REM-included composite inclusion, MnS, CaO—$Al_2O_3$-based inclusion, and the like in the inclusions may be identified.

As evaluation criteria of the inclusions, in a case of the A-type inclusion, B-type inclusion, and the C-type inclusion (the total number of the B-type and C-type inclusions was evaluated), a case in which the number density exceeded 5 pieces/mm$^2$ was set as B (Bad), a case of more than 3 pieces/mm$^2$ to 5 pieces/mm$^2$ was set as G (Good), and a case of 1 pieces/mm$^2$ to 3 pieces/mm$^2$ was set as VG (Very Good), and a case of 1 pieces/mm$^2$ or less set as GG (Greatly Good). In a case of a coarse inclusion having the maximum length of 20 μm or more as the B-type and C-type, a case of more than 3 pieces/mm$^2$ was set as B (Bad), a case of more than 1 pieces/mm$^2$ to 3 pieces/mm$^2$ was set as G (Good), a case of 1 pieces/mm$^2$ or less was set as VG (Very Good). In addition, in a case of Ti-included-carbonitrides that were independently present in steel and had a long side of 5 μm or more, a case in which the number density is larger than 3 pieces/mm$^2$ was set as B (Bad), a case of more than 2 pieces/mm$^2$ to 3 pieces/mm$^2$ was set as G (Good), and a case of 2 pieces/mm$^2$ or less was set as VG (Very Good).

In addition, with respect to the cold-rolled steel sheet that was obtained, a quenching treatment and a tempering treatment were performed to evaluate toughness, fatigue properties, and hardness. The quenching was performed by heating the cold-rolled steel sheet to 900° C. and retaining the cold-rolled steel sheet for 30 minutes. Then, the tempering treatment was performed by heating the cold-rolled steel sheet to 220° C., retaining the cold-rolled steel sheet for 60 minutes, and cooling the cold-rolled steel sheet in a furnace. An impact value at room temperature was measured by Charpy test (for example, ISO 148-1: 2003) to evaluate toughness. A pulsating tensile test (for example, ISO 1099: 2006) was performed to evaluate fatigue properties. In the pulsating tensile test, an S—N curve was created to obtain a fatigue limit. A Vickers hardness measuring test (for example, ISO 6507-1: 2005) at room temperature was performed to evaluate hardness (strength). As evaluation criteria of respective properties, 6 J/cm$^2$ or more of impact value, 500 MPa or more of fatigue limit, and 500 or more of hardness were evaluated as "pass".

In addition, with respect to chemical components of the hot-rolled steel sheet that was obtained, quantitative analysis was performed using ICP-AES (Inductively Coupled Plasma-Atomic Emission Spectroscopy), or ICP-MS (Inductively Coupled Plasma-Mass Spectrometry). In addition, a minute amount of REM elements may be less than an analysis limit in some cases. In this case, calculation may be performed using the ratio of the element to an analyzed value of Ce with the largest amount that is proportional to the amount in a misch metal (50% of Ce, 25% of La, and 10% of Nd). In addition, the right-hand side value of the following Expression 1, the right-hand side value of the following Expression 2, and the left-hand side value of the following Expression 3, which are calculated from the amounts of the respective elements in the chemical components which are represented by mass %, are shown in Table 4.

$$0.3 \leq \{Ca/40.88+(REM/140)/2\}(S/32.07) \quad \text{(Expression 1)}$$

$$Ca \leq 0.005-0.0035 \times C \quad \text{(Expression 2)}$$

$$18 \times (REM/140)-O/16 \geq 0 \quad \text{(Expression 3)}$$

Production conditions and production results are show Tables 2 to 4. In tables, an underline is given to a numerical value deviating from the range of the invention. All examples satisfied the range of the invention, and steel sheets of the examples were excellent in strength (hardness), toughness, and fatigue properties. On the other hand, since comparative examples did not satisfy conditions of the invention, the hardness (strength), toughness, fatigue properties, and the like were not sufficient.

TABLE 2

| | | HOT-ROLLED SHEET ANNEALING | | COLD ROLLING | COLD-ROLLED SHEET ANNEALING | | SKIN PASS ROLLING |
|---|---|---|---|---|---|---|---|
| | | ANNEALING TEMPERATURE (° C.) | RETENTION TIME (hr) | ROLLING REDUCTION (%) | ANNEALING TEMPERATURE (° C.) | RETENTION TIME (hr) | ROLLING REDUCTION (%) |
| EXAMPLES | 1 | 730 | 48 | 50 | 720 | 48 | — |
| | 2 | 750 | 48 | 55 | 750 | 48 | — |
| | 3 | 710 | 48 | 50 | 710 | 48 | — |
| | 4 | 720 | 48 | 40 | 710 | 36 | — |
| | 5 | 720 | 48 | 50 | 710 | 48 | 2.0 |
| | 6 | 730 | 36 | 25 | 710 | 48 | — |
| | 7 | 730 | 36 | 25 | 710 | 48 | — |
| | 8 | 720 | 48 | 40 | 710 | 36 | 4.0 |
| | 9 | 730 | 36 | 25 | 710 | 48 | 4.0 |
| | 10 | 750 | 48 | 55 | 710 | 48 | — |
| | 11 | 740 | 48 | 55 | 720 | 48 | 1.0 |
| | 12 | 750 | 48 | 30 | 710 | 24 | 2.5 |
| | 13 | 720 | 48 | 50 | 710 | 48 | — |
| | 14 | 710 | 48 | 55 | 710 | 48 | — |
| | 15 | 750 | 48 | 50 | 710 | 48 | — |
| | 16 | 730 | 36 | 25 | 710 | 48 | — |
| | 17 | 750 | 48 | 50 | 750 | 48 | 3.0 |
| | 18 | — | — | 50 | 750 | 48 | — |
| | 19 | 720 | 48 | 50 | 710 | 48 | — |
| | 20 | — | — | 50 | 750 | 48 | — |
| | 21 | 720 | 48 | 50 | 710 | 48 | — |
| | 22 | 740 | 48 | 50 | 720 | 48 | — |
| | 23 | 750 | 48 | 55 | 710 | 48 | 3.5 |
| | 24 | 730 | 48 | 50 | 710 | 48 | — |
| | 25 | 710 | 24 | 0 | 710 | 48 | 2.5 |
| | 26 | 730 | 48 | 55 | 720 | 48 | — |
| | 27 | 710 | 48 | 50 | 710 | 48 | 0.5 |
| | 28 | 710 | 48 | 40 | 710 | 48 | — |
| | 29 | 710 | 48 | 30 | 710 | 48 | — |
| | 30 | 710 | 48 | 20 | 710 | 48 | 1.5 |
| | 31 | 710 | 48 | 25 | 710 | 48 | — |
| | 32 | 710 | 48 | 25 | 710 | 48 | — |
| | 33 | 710 | 48 | 35 | 710 | 48 | 4.0 |
| | 34 | 710 | 48 | 35 | 710 | 48 | — |
| | 35 | 710 | 48 | 45 | 710 | 48 | — |
| | 36 | 710 | 48 | 45 | 710 | 48 | 3.0 |
| | 37 | 710 | 48 | 55 | 710 | 48 | — |
| | 38 | 710 | 48 | 55 | 710 | 48 | — |
| | 39 | 710 | 48 | 50 | 710 | 48 | 4.0 |
| COMPARATIVE EXAMPLES | 1 | 710 | 48 | 55 | 710 | 48 | — |
| | 2 | 710 | 48 | 55 | 710 | 48 | — |
| | 3 | 710 | 48 | 45 | 710 | 48 | — |
| | 4 | 710 | 48 | 40 | 710 | 48 | — |
| | 5 | 710 | 48 | 50 | 710 | 48 | 2.5 |
| | 6 | 710 | 48 | 55 | 710 | 48 | — |
| | 7 | 710 | 48 | 40 | 710 | 48 | 3.0 |
| | 8 | 710 | 48 | 45 | 710 | 48 | — |
| | 9 | 710 | 48 | 45 | 710 | 48 | — |
| | 10 | 710 | 48 | 50 | 710 | 48 | — |
| | 11 | 710 | 48 | 55 | 710 | 48 | 4.0 |
| | 12 | 710 | 48 | 50 | 710 | 48 | — |
| | 13 | 710 | 48 | 45 | 710 | 48 | — |
| | 14 | 720 | 48 | 40 | 710 | 36 | 4.0 |
| | 15 | 730 | 48 | 60 | 710 | 48 | 2.5 |
| | 16 | 750 | 48 | 30 | 710 | 24 | — |
| | 17 | 710 | 48 | 50 | 710 | 48 | — |
| | 18 | 730 | 48 | 50 | 710 | 48 | — |
| | 19 | 710 | 24 | 0 | 710 | 48 | 3.5 |
| | 20 | 710 | 48 | 50 | 710 | 48 | — |
| | 21 | 710 | 48 | 55 | 710 | 48 | — |
| | 22 | 710 | 48 | 55 | 710 | 48 | — |
| | 23 | 710 | 48 | 50 | 710 | 48 | — |
| | 24 | 710 | 48 | 50 | 710 | 48 | 2.0 |
| | 25 | 710 | 48 | 40 | 710 | 48 | — |
| | 26 | 710 | 48 | 45 | 710 | 48 | — |
| | 27 | 710 | 48 | 35 | 710 | 48 | 2.5 |
| | 28 | 710 | 48 | 30 | 710 | 48 | — |
| | 29 | 710 | 48 | 50 | 710 | 48 | 1.0 |

TABLE 3

| | | CHEMICAL COMPONENT (mass %) | | | | | | | | | | | | | | | |
|---|---|---|---|---|---|---|---|---|---|---|---|---|---|---|---|---|---|
| | | C | Si | Mn | Al | Ti | Cr | Ca | REM | P | S | O | N | Cu | Nb | V | Mo |
| EXAMPLES | 1 | 0.50 | 0.43 | 0.41 | 0.039 | 0.006 | 0.63 | 0.0021 | 0.0031 | 0.008 | 0.0036 | 0.0021 | 0.0037 | | | | |
| | 2 | 0.80 | 0.59 | 0.90 | 0.029 | 0.003 | 0.42 | 0.0017 | 0.0022 | 0.020 | 0.0048 | 0.0023 | 0.0029 | | | | |
| | 3 | 0.78 | 0.15 | 0.52 | 0.027 | 0.005 | 0.43 | 0.0005 | 0.0040 | 0.013 | 0.0028 | 0.0019 | 0.0025 | | 0.03 | 0.02 | |
| | 4 | 0.53 | 0.36 | 0.56 | 0.035 | 0.005 | 0.41 | 0.0029 | 0.0025 | 0.010 | 0.0009 | 0.0020 | 0.0025 | | | | |
| | 5 | 0.76 | 0.39 | 0.41 | 0.031 | 0.003 | 0.37 | 0.0010 | 0.0003 | 0.012 | 0.0027 | 0.0025 | 0.0034 | | 0.02 | | 0.01 |
| | 6 | 0.69 | 0.44 | 0.59 | 0.040 | 0.003 | 0.66 | 0.0019 | 0.0003 | 0.010 | 0.0011 | 0.0011 | 0.0025 | | | | |
| | 7 | 0.67 | 0.45 | 0.55 | 0.033 | 0.004 | 0.65 | 0.0016 | 0.0004 | 0.012 | 0.0005 | 0.0015 | 0.0027 | | | | |
| | 8 | 0.51 | 0.38 | 0.65 | 0.040 | 0.003 | 0.50 | 0.0013 | 0.0049 | 0.010 | 0.0024 | 0.0020 | 0.0025 | | | | |
| | 9 | 0.55 | 0.41 | 0.57 | 0.031 | 0.006 | 0.58 | 0.0014 | 0.0023 | 0.001 | 0.0003 | 0.0024 | 0.0031 | | | | |
| | 10 | 0.78 | 0.19 | 0.55 | 0.053 | 0.008 | 0.30 | 0.0015 | 0.0019 | 0.010 | 0.0005 | 0.0018 | 0.0021 | | | | 0.03 |
| | 11 | 0.70 | 0.31 | 0.63 | 0.032 | 0.005 | 0.48 | 0.0025 | 0.0018 | 0.011 | 0.0069 | 0.0032 | 0.0037 | | 0.02 | 0.01 | |
| | 12 | 0.65 | 0.39 | 0.64 | 0.038 | 0.004 | 0.48 | 0.0021 | 0.0020 | 0.011 | 0.0022 | 0.0005 | 0.0034 | | | | |
| | 13 | 0.77 | 0.45 | 0.44 | 0.017 | 0.007 | 0.40 | 0.0016 | 0.0033 | 0.007 | 0.0033 | 0.0040 | 0.0058 | | 0.05 | | |
| | 14 | 0.71 | 0.25 | 0.48 | 0.024 | 0.002 | 0.38 | 0.0010 | 0.0012 | 0.018 | 0.0031 | 0.0022 | 0.0038 | 0.03 | | | |
| | 15 | 0.75 | 0.26 | 0.52 | 0.027 | 0.005 | 0.51 | 0.0021 | 0.0027 | 0.009 | 0.0004 | 0.0014 | 0.0024 | | | | |
| | 16 | 0.65 | 0.40 | 0.54 | 0.038 | 0.007 | 0.42 | 0.0020 | 0.0024 | 0.013 | 0.0003 | 0.0020 | 0.0030 | | | | |
| | 17 | 0.67 | 0.51 | 0.78 | 0.031 | 0.010 | 0.69 | 0.0027 | 0.0036 | 0.012 | 0.0033 | 0.0025 | 0.0047 | | | | |
| | 18 | 0.74 | 0.32 | 0.46 | 0.028 | 0.004 | 0.37 | 0.0021 | 0.0014 | 0.010 | 0.0024 | 0.0028 | 0.0025 | | | | |
| | 19 | 0.77 | 0.41 | 0.44 | 0.017 | 0.007 | 0.40 | 0.0016 | 0.0010 | 0.007 | 0.0033 | 0.0034 | 0.0064 | | 0.05 | | |
| | 20 | 0.76 | 0.34 | 0.45 | 0.031 | 0.006 | 0.42 | 0.0021 | 0.0016 | 0.010 | 0.0035 | 0.0040 | 0.0025 | | | | |
| | 21 | 0.73 | 0.28 | 0.58 | 0.010 | 0.006 | 0.44 | 0.0014 | 0.0025 | 0.006 | 0.0045 | 0.0023 | 0.0025 | | 0.05 | | |
| | 22 | 0.72 | 0.27 | 0.60 | 0.070 | 0.002 | 0.69 | 0.0013 | 0.0032 | 0.015 | 0.0022 | 0.0024 | 0.0027 | | | | |
| | 23 | 0.74 | 0.22 | 0.55 | 0.047 | 0.001 | 0.41 | 0.0018 | 0.0028 | 0.006 | 0.0015 | 0.0021 | 0.0022 | | | 0.02 | |
| | 24 | 0.58 | 0.42 | 0.75 | 0.030 | 0.010 | 0.51 | 0.0015 | 0.0029 | 0.010 | 0.0050 | 0.0020 | 0.0025 | | | | |
| | 25 | 0.75 | 0.38 | 0.88 | 0.033 | 0.005 | 0.30 | 0.0022 | 0.0042 | 0.010 | 0.0024 | 0.0020 | 0.0025 | | | | |
| | 26 | 0.73 | 0.34 | 0.56 | 0.033 | 0.003 | 0.70 | 0.0015 | 0.0024 | 0.005 | 0.0034 | 0.0020 | 0.0041 | | | | 0.04 |
| | 27 | 0.73 | 0.23 | 0.61 | 0.012 | 0.006 | 0.34 | 0.0019 | 0.0038 | 0.010 | 0.0024 | 0.0020 | 0.0054 | | | | |
| | 28 | 0.72 | 0.24 | 0.59 | 0.013 | 0.005 | 0.31 | 0.0021 | 0.0038 | 0.011 | 0.0023 | 0.0022 | 0.0075 | 0.002 | | | |
| | 29 | 0.72 | 0.24 | 0.60 | 0.015 | 0.005 | 0.32 | 0.0022 | 0.0040 | 0.011 | 0.0025 | 0.0023 | 0.0043 | 0.049 | | | |
| | 30 | 0.71 | 0.51 | 0.59 | 0.028 | 0.004 | 0.33 | 0.0020 | 0.0042 | 0.018 | 0.0020 | 0.0028 | 0.0035 | | 0.001 | | |
| | 31 | 0.71 | 0.26 | 0.59 | 0.023 | 0.003 | 0.30 | 0.0018 | 0.0035 | 0.005 | 0.0019 | 0.0022 | 0.0041 | | 0.048 | | |
| | 32 | 0.72 | 0.29 | 0.63 | 0.024 | 0.003 | 0.30 | 0.0019 | 0.0032 | 0.010 | 0.0018 | 0.0025 | 0.0028 | | | 0.002 | |
| | 33 | 0.72 | 0.28 | 0.76 | 0.027 | 0.003 | 0.45 | 0.0020 | 0.0030 | 0.009 | 0.0019 | 0.0023 | 0.0026 | | | 0.050 | |
| | 34 | 0.76 | 0.33 | 0.57 | 0.020 | 0.008 | 0.37 | 0.0022 | 0.0026 | 0.011 | 0.0021 | 0.0027 | 0.0039 | | | | 0.001 |
| | 35 | 0.75 | 0.30 | 0.55 | 0.018 | 0.009 | 0.33 | 0.0020 | 0.0026 | 0.017 | 0.0022 | 0.0030 | 0.0041 | | | | 0.049 |
| | 36 | 0.74 | 0.37 | 0.53 | 0.033 | 0.010 | 0.62 | 0.0021 | 0.0023 | 0.012 | 0.0020 | 0.0031 | 0.0051 | | | | |
| | 37 | 0.74 | 0.35 | 0.51 | 0.027 | 0.010 | 0.35 | 0.0023 | 0.0021 | 0.020 | 0.0021 | 0.0032 | 0.0065 | | | | |
| | 38 | 0.72 | 0.28 | 0.63 | 0.035 | 0.009 | 0.34 | 0.0025 | 0.0021 | 0.015 | 0.0023 | 0.0027 | 0.0072 | | | | |
| | 39 | 0.72 | 0.28 | 0.87 | 0.033 | 0.010 | 0.54 | 0.0024 | 0.0022 | 0.009 | 0.0022 | 0.0029 | 0.0053 | | | | |
| COMPARATIVE EXAMPLES | 1 | 0.49 | 0.29 | 0.64 | 0.024 | 0.005 | 0.45 | 0.0021 | 0.0019 | 0.010 | 0.0021 | 0.0022 | 0.0043 | | | | |
| | 2 | 0.81 | 0.28 | 0.66 | 0.025 | 0.005 | 0.42 | 0.0020 | 0.0018 | 0.011 | 0.0023 | 0.0019 | 0.0037 | | | | |
| | 3 | 0.71 | 0.14 | 0.65 | 0.025 | 0.003 | 0.43 | 0.0018 | 0.0017 | 0.012 | 0.0024 | 0.0017 | 0.0052 | | | | |
| | 4 | 0.73 | 0.61 | 0.65 | 0.026 | 0.004 | 0.42 | 0.0017 | 0.0020 | 0.010 | 0.0024 | 0.0017 | 0.0052 | | | | |
| | 5 | 0.72 | 0.29 | 0.39 | 0.025 | 0.004 | 0.43 | 0.0019 | 0.0018 | 0.011 | 0.0024 | 0.0017 | 0.0052 | | | | |
| | 6 | 0.71 | 0.28 | 0.91 | 0.024 | 0.005 | 0.43 | 0.0020 | 0.0018 | 0.010 | 0.0024 | 0.0017 | 0.0052 | | | | |
| | 7 | 0.72 | 0.29 | 0.64 | 0.009 | 0.004 | 0.42 | 0.0021 | 0.0018 | 0.010 | 0.0024 | 0.0017 | 0.0052 | | | | |
| | 8 | 0.70 | 0.30 | 0.65 | 0.071 | 0.005 | 0.43 | 0.0019 | 0.0016 | 0.009 | 0.0024 | 0.0017 | 0.0052 | | | | |
| | 9 | 0.72 | 0.28 | 0.64 | 0.025 | 0.0009 | 0.40 | 0.0018 | 0.0019 | 0.010 | 0.0024 | 0.0017 | 0.0052 | | | | |
| | 10 | 0.72 | 0.29 | 0.65 | 0.026 | 0.011 | 0.42 | 0.0019 | 0.0019 | 0.011 | 0.0024 | 0.0017 | 0.0052 | | | | |
| | 11 | 0.71 | 0.30 | 0.66 | 0.025 | 0.005 | 0.29 | 0.0020 | 0.0018 | 0.012 | 0.0024 | 0.0017 | 0.0052 | | | | |
| | 12 | 0.72 | 0.29 | 0.65 | 0.024 | 0.003 | 0.71 | 0.0019 | 0.0022 | 0.010 | 0.0024 | 0.0017 | 0.0052 | | | | |
| | 13 | 0.73 | 0.29 | 0.65 | 0.025 | 0.004 | 0.43 | 0.0004 | 0.0043 | 0.011 | 0.0024 | 0.0017 | 0.0052 | | | | |
| | 14 | 0.52 | 0.37 | 0.66 | 0.038 | 0.005 | 0.51 | 0.0031 | 0.0040 | 0.010 | 0.0023 | 0.0018 | 0.0056 | | | | |
| | 15 | 0.71 | 0.31 | 0.59 | 0.027 | 0.007 | 0.41 | 0.0019 | 0.0000 | 0.012 | 0.0035 | 0.0023 | 0.0035 | | 0.04 | 0.02 | |
| | 16 | 0.67 | 0.35 | 0.63 | 0.039 | 0.004 | 0.47 | 0.0018 | 0.0002 | 0.010 | 0.0024 | 0.0015 | 0.0052 | | | | |
| | 17 | 0.72 | 0.30 | 0.65 | 0.025 | 0.004 | 0.45 | 0.0019 | 0.0055 | 0.011 | 0.0024 | 0.0017 | 0.0052 | | | | |
| | 18 | 0.59 | 0.41 | 0.65 | 0.033 | 0.005 | 0.50 | 0.0017 | 0.0026 | 0.009 | 0.0057 | 0.0020 | 0.0025 | | | | |
| | 19 | 0.74 | 0.39 | 0.61 | 0.038 | 0.006 | 0.53 | 0.0028 | 0.0036 | 0.010 | 0.0024 | 0.0020 | 0.0025 | | | | |
| | 20 | 0.71 | 0.25 | 0.59 | 0.033 | 0.005 | 0.39 | 0.0020 | 0.0025 | 0.021 | 0.0024 | 0.0020 | 0.0025 | | | | |
| | 21 | 0.70 | 0.25 | 0.58 | 0.031 | 0.005 | 0.37 | 0.0019 | 0.0051 | 0.010 | 0.0071 | 0.0020 | 0.0025 | | | | |
| | 22 | 0.70 | 0.24 | 0.59 | 0.029 | 0.003 | 0.35 | 0.0018 | 0.0025 | 0.010 | 0.0024 | 0.0041 | 0.0025 | | | | |
| | 23 | 0.71 | 0.25 | 0.57 | 0.034 | 0.004 | 0.39 | 0.0020 | 0.0025 | 0.010 | 0.0024 | 0.0035 | 0.0077 | | | | |
| | 24 | 0.71 | 0.26 | 0.59 | 0.030 | 0.005 | 0.40 | 0.0020 | 0.0025 | 0.010 | 0.0024 | 0.0020 | 0.0025 | 0.051 | | | |
| | 25 | 0.69 | 0.25 | 0.60 | 0.029 | 0.006 | 0.38 | 0.0021 | 0.0024 | 0.010 | 0.0024 | 0.0020 | 0.0025 | | 0.051 | | |
| | 26 | 0.71 | 0.24 | 0.56 | 0.030 | 0.007 | 0.36 | 0.0021 | 0.0023 | 0.010 | 0.0024 | 0.0020 | 0.0025 | | | 0.051 | |
| | 27 | 0.70 | 0.25 | 0.60 | 0.035 | 0.005 | 0.37 | 0.0019 | 0.0026 | 0.010 | 0.0024 | 0.0000 | 0.0025 | | | | 0.051 |
| | 28 | 0.71 | 0.25 | 0.57 | 0.037 | 0.004 | 0.35 | 0.0020 | 0.0024 | 0.010 | 0.0024 | 0.0020 | 0.0025 | | | | |
| | 29 | 0.71 | 0.25 | 0.56 | 0.039 | 0.005 | 0.39 | 0.0020 | 0.0027 | 0.010 | 0.0024 | 0.0020 | 0.0025 | | | | |

TABLE 4

| | | CHEMICAL COMPONENTS (mass %) | | | | | INCLUSIONS | | | | CHARACTERISTIC VALUES | | | |
|---|---|---|---|---|---|---|---|---|---|---|---|---|---|---|
| | | Ni | B | RIGHT SIDE OF EXPRESSION 1 | RIGHT SIDE OF EXPRESSION 2 | LEFT SIDE OF EXPRESSION 3 | A-TYPE | B-TYPE + C-TYPE | COARSE INCLUSION ≥20 μM | NUMBER DENSITY OF TI-INCLUDED-CARBONITRIDES (PIECES/nm$^{2)}$ | HARDNESS (Hv) | IMPACT VALUE (J/CM$^2$) | FATIGUE LIMIT (MPa) | REMARKS |
| EXAMPLES | 1 | | | 0.56 | 0.0033 | 0.0003 | VG | VG | VG | VG | 505 | 7.5 | 600 | |
| | 2 | | | 0.33 | 0.0022 | 0.0001 | VG | VG | VG | VG | 575 | 7.0 | 500 | |
| | 3 | | | 0.30 | 0.0023 | 0.0004 | G | GG | VG | VG | 560 | 6.7 | 500 | |
| | 4 | | | 2.85 | 0.0031 | 0.0002 | GG | VG | VG | VG | 515 | 6.2 | 700 | |
| | 5 | | | 0.30 | 0.0023 | −0.0001 | G | VG | VG | G | 550 | 6.3 | 550 | |
| | 6 | | | 1.39 | 0.0026 | 0.0000 | VG | VG | VG | G | 540 | 6.1 | 450 | |
| | 7 | | | 2.50 | 0.0027 | 0.0000 | GG | VG | VG | G | 535 | 6.8 | 450 | |
| | 8 | | | 0.66 | 0.0032 | 0.0005 | VG | GG | VG | VG | 515 | 8.8 | 700 | |
| | 9 | | | 4.54 | 0.0031 | 0.0001 | GG | GG | VG | VG | 510 | 6.1 | 750 | |
| | 10 | | | 2.79 | 0.0023 | 0.0001 | GG | VG | VG | VG | 545 | 8.3 | 650 | |
| | 11 | | | 0.31 | 0.0026 | 0.0000 | G | G | VG | VG | 530 | 6.4 | 500 | |
| | 12 | | | 0.85 | 0.0027 | 0.0002 | VG | VG | VG | VG | 525 | 7.5 | 600 | |
| | 13 | | | 0.49 | 0.0023 | 0.0002 | VG | VG | VG | VG | 535 | 6.3 | 550 | |
| | 14 | 0.030 | | 0.30 | 0.0025 | 0.0000 | G | GG | VG | VG | 530 | 6.8 | 500 | |
| | 15 | | | 4.89 | 0.0024 | 0.0003 | GG | VG | VG | VG | 540 | 7.8 | 650 | |
| | 16 | | | 6.15 | 0.0027 | 0.0002 | VG | G | G | VG | 520 | 6.7 | 750 | |
| | 17 | | 0.0011 | 0.77 | 0.0027 | 0.0003 | VG | G | VG | VG | 525 | 8.0 | 650 | |
| | 18 | | | 0.75 | 0.0024 | 0.0000 | VG | VG | VG | VG | 535 | 8.1 | 650 | |
| | 19 | | | 0.42 | 0.0023 | −0.0001 | G | VG | VG | VG | 540 | 6.3 | 550 | |
| | 20 | | | 0.52 | 0.0023 | 0.0000 | G | VG | VG | VG | 535 | 6.1 | 500 | |
| | 21 | | | 0.31 | 0.0024 | 0.0002 | G | VG | VG | VG | 535 | 7.3 | 500 | |
| | 22 | | | 0.63 | 0.0025 | 0.0003 | VG | VG | VG | VG | 530 | 7.3 | 550 | |
| | 23 | | | 1.16 | 0.0024 | 0.0002 | VG | VG | VG | VG | 525 | 7.9 | 600 | |
| | 24 | | | 0.30 | 0.0030 | 0.0002 | G | VG | VG | VG | 515 | 6.0 | 500 | |
| | 25 | | | 0.92 | 0.0024 | 0.0004 | VG | VG | VG | VG | 535 | 8.8 | 700 | |
| | 26 | | | 0.43 | 0.0024 | 0.0002 | VG | VG | VG | VG | 540 | 6.9 | 550 | |
| | 27 | | | 0.80 | 0.0024 | 0.0004 | VG | VG | VG | VG | 525 | 8.2 | 600 | |
| | 28 | | | 0.91 | 0.0025 | 0.0004 | VG | VG | VG | VG | 520 | 8.0 | 650 | |
| | 29 | | | 0.87 | 0.0025 | 0.0004 | VG | VG | VG | VG | 535 | 8.6 | 650 | |
| | 30 | | | 1.03 | 0.0025 | 0.0004 | VG | VG | VG | VG | 540 | 7.7 | 600 | |
| | 31 | | | 0.95 | 0.0025 | 0.0003 | VG | VG | VG | VG | 530 | 7.3 | 650 | |
| | 32 | | | 1.03 | 0.0025 | 0.0003 | VG | VG | VG | VG | 510 | 7.1 | 600 | |
| | 33 | | | 1.01 | 0.0025 | 0.0002 | VG | VG | VG | VG | 625 | 6.8 | 600 | |
| | 34 | | | 0.96 | 0.0023 | 0.0002 | VG | G | VG | VG | 530 | 7.5 | 550 | |
| | 35 | | | 0.85 | 0.0024 | 0.0001 | VG | VG | VG | VG | 525 | 8.0 | 650 | |
| | 36 | 0.002 | | 0.96 | 0.0024 | 0.0001 | VG | VG | VG | VG | 520 | 9.1 | 700 | |
| | 37 | 0.050 | | 0.97 | 0.0024 | 0.0001 | VG | G | VG | VG | 540 | 8.6 | 850 | |
| | 38 | | 0.0001 | 0.96 | 0.0025 | 0.0001 | VG | G | VG | VG | 530 | 7.7 | 700 | |
| | 39 | | 0.0048 | 0.97 | 0.0025 | 0.0001 | VG | G | VG | VG | 520 | 8.3 | 700 | |
| COMPARATIVE EXAMPLES | 1 | | | 0.89 | 0.0033 | 0.0001 | VG | VG | VG | VG | 490 | 6.9 | 550 | |
| | 2 | | | 0.77 | 0.0022 | 0.0001 | VG | VG | VG | VG | 575 | 5.7 | 450 | |

TABLE 4-continued

| | CHEMICAL COMPONENTS (mass %) | | | | | INCLUSIONS | | | | CHARACTERISTIC VALUES | | | |
|---|---|---|---|---|---|---|---|---|---|---|---|---|---|
| | Ni | B | RIGHT SIDE OF EXPRESSION 1 | RIGHT SIDE OF EXPRESSION 2 | LEFT SIDE OF EXPRESSION 3 | A-TYPE | B-TYPE + C-TYPE | COARSE INCLUSION ≥20 μM | NUMBER DENSITY OF TI-INCLUDED-CARBONITRIDES (PIECES/nm$^{2)}$ | HARDNESS (Hv) | IMPACT VALUE (J/CM$^2$) | FATIGUE LIMIT (MPa) | REMARKS |
| 3 | | | 0.67 | 0.0025 | 0.0001 | VG | VG | VG | VG | 485 | 6.3 | 550 | |
| 4 | | | 0.65 | 0.0024 | 0.0002 | VG | VG | VG | VG | 555 | 6.2 | 500 | SCALE DEFECTS WERE OCCURRED DURING HOT ROLING. |
| 5 | | | 0.71 | 0.0025 | 0.0001 | VG | VG | VG | VG | 490 | 6.5 | 550 | |
| 6 | | | 0.74 | 0.0025 | 0.0001 | VG | VG | VG | VG | 565 | 5.5 | 450 | |
| 7 | | | 0.77 | 0.0025 | 0.0001 | B | VG | VG | VG | 515 | 5.3 | 400 | |
| 8 | | | 0.70 | 0.0026 | 0.0001 | VG | VG | B | VG | 520 | 5.6 | 400 | |
| 9 | | | 0.68 | 0.0025 | 0.0001 | VG | VG | VG | VG | 498 | 6.5 | 550 | |
| 10 | | | 0.71 | 0.0025 | 0.0001 | VG | VG | VG | B | 575 | 5.3 | 450 | |
| 11 | | | 0.74 | 0.0025 | 0.0001 | VG | VG | VG | VG | 475 | 6.9 | 600 | |
| 12 | | | 0.73 | 0.0025 | 0.0002 | VG | VG | VG | VG | 565 | 6.6 | 550 | ADDITIONAL COST WAS BEYOND A PERMISSIBLE RANGE. |
| 13 | | | 0.34 | 0.0024 | 0.0004 | VG | GG | G | VG | 515 | 3.3 | 300 | NOZZLE CLOGGING WAS GENERATED. |
| 14 | | | 1.26 | 0.0032 | 0.0004 | B | G | B | VG | 520 | 5.4 | 450 | |
| 15 | | | 0.43 | 0.0025 | −0.0001 | B | VG | VG | B | 515 | 4.4 | 400 | |
| 16 | | | 0.60 | 0.0027 | −0.0001 | B | VG | VG | B | 520 | 4.8 | 400 | |
| 17 | | | 0.88 | 0.0025 | 0.0000 | VG | VG | B | VG | 525 | 4.9 | 450 | NOZZLE CLOGGING WAS GENERATED. |
| 18 | | | 0.29 | 0.0029 | 0.0002 | B | VG | VG | VG | 510 | 3.8 | 300 | |
| 19 | | | 1.09 | 0.0024 | 0.0003 | VG | B | VG | VG | 530 | 4.9 | 400 | |
| 20 | | | 0.77 | 0.0025 | 0.0002 | VG | VG | VG | VG | 535 | 5.1 | 400 | |
| 21 | | | 0.29 | 0.0026 | 0.0005 | G | VG | VG | VG | 520 | 5.3 | 400 | |
| 22 | | | 0.71 | 0.0026 | 0.0001 | VG | VG | VG | VG | 515 | 5.4 | 400 | |
| 23 | | | 0.77 | 0.0025 | 0.0001 | VG | VG | VG | VG | 525 | 5.2 | 400 | |
| 24 | | | 0.77 | 0.0025 | 0.0002 | VG | VG | VG | VG | 560 | 3.7 | 300 | CRACK WAS OCCURRED DURING HOT ROLLING. |
| 25 | | | 0.80 | 0.0026 | 0.0002 | VG | VG | VG | VG | 560 | 4.1 | 350 | |
| 26 | | | 0.80 | 0.0025 | 0.0002 | VG | VG | VG | VG | 555 | 4.2 | 350 | |
| 27 | | | 0.75 | 0.0026 | 0.0002 | VG | VG | VG | VG | 545 | 6.7 | 500 | ADDITIONAL COST WAS BEYOND A PERMISSIBLE RANGE. |
| 28 | 0.051 | | 0.77 | 0.0025 | 0.0002 | VG | VG | VG | VG | 540 | 6.7 | 550 | ADDITIONAL COST WAS BEYOND A PERMISSIBLE RANGE. |
| 29 | | 0.0051 | 0.78 | 0.0025 | 0.0002 | VG | VG | VG | VG | 530 | 4.4 | 400 | |

INDUSTRIAL APPLICABILITY

According to the above-described aspects of the invention, a steel sheet, which has excellent strength (hardness), wear resistance, and cold punching workability, and which has excellent toughness and fatigue properties due to a reduction in A-type inclusions, B-type inclusions, and C-type inclusions in steel and by preventing coarse Ti-included-carbonitrides from being generated, may be provided. Accordingly, the industrial applicability is high.

The invention claimed is:

1. A steel sheet in which chemical components of a steel include, by mass %:

0.5% to 0.8% of C;

0.15% to 0.60% of Si;

0.40% to 0.90% of Mn;

0.010% to 0.070% of Al;

0.001% to 0.010% of Ti;

0.30% to 0.70% of Cr;

0.0005% to 0.0030% of Ca;

0.0003% to 0.0050% of REM;

0.020% or less of P;

0.0070% or less of S;

0.0040% or less of O; and 0.0075% or less of N, the balance composed of Fe and unavoidable impurities, wherein the amounts of the respective elements in the chemical components, which are represented by mass %, satisfy the following Expression 1 and Expression 2, and the steel contains a Ti-included-carbonitride as an inclusion, and a number density of the Ti-included-carbonitride having a long side of 5 μm or more is 3 pieces/$mm^2$ or less;

$$0.3 \leq \{Ca/40.88+(REM/140)/2\}(S/32.07) \quad \text{(Expression 1)}$$

$$Ca \leq 0.005-0.0035 \times C \quad \text{(Expression 2).}$$

2. The sheet according to claim 1, wherein the chemical components further include at least one selected from a group consisting of, by mass %, 0% to 0.05% of Cu, 0% to 0.05% of Nb, 0% to 0.05% of V, 0% to 0.05% of Mo, 0% to 0.05% of Ni, and 0% to 0.0050% of B.

3. The steel sheet according to claim 1 or 2, wherein the steel further contains a composite inclusion including Al, Ca, O, S, and REM, and an inclusion in which the Ti-included-carbonitride is attached to a surface of the composite inclusion.

4. The steel sheet according to claim 3, wherein the amounts of the respective elements in the chemical components, which are represented by mass %, satisfy the following Expression 3;

$$18 \times (REM/140)-O/16 \geq 0 \quad \text{(Expression 3).}$$

5. The steel sheet according to claim 1 or 2, wherein the amounts of the respective elements in the chemical components, which are represented by mass %, satisfy the following Expression 4;

$$18 \times (REM/140)-O/16 \geq 0 \quad \text{(Expression 4).}$$

* * * * *

UNITED STATES PATENT AND TRADEMARK OFFICE

CERTIFICATE OF CORRECTION

PATENT NO. : 9,051,634 B2
APPLICATION NO. : 14/351399
DATED : June 9, 2015
INVENTOR(S) : Morohoshi et al.

It is certified that error appears in the above-identified patent and that said Letters Patent is hereby corrected as shown below:

In the specification

Column 1, line 48, change "the steel is lows and medium" to -- the steel is low and medium --;

Column 2, line 1, change "Japanese unexamined Patent" to -- Japanese Unexamined Patent --;

Column 3, line 6, change "The invention as been made" to -- The invention has been made --;

Column 3, line 38, change "which are represented by satisfy" to -- which are represented by mass% satisfy --;

Column 3, line 59, change "by mass%, satisfy the" to -- by mass%, may satisfy the --;

Column 5, line 39, change "The present inventors haze examined" to -- The present inventors have examined --;

Column 6, line 26, change "tensile testis performed" to -- tensile test is performed --;

Column 10, line 58, change "the halt of the" to -- the half of the --;

Column 11, line 28, change "In addition. Si is" to -- In addition, Si is --;

Column 13, line 3, change "steel as a misch metal that" to -- steel as a mischmetal that --;

Column 13, line 28, change "Obtained by rolling" to -- obtained by rolling --;

Column 13, line 34, change "set to 0.0010%" to -- set to 0.0040% --;

Column 14, line 36, change "amount of O ray be 0%" to -- amount of O may be 0% --;

Column 14, line 57, change "$REM_2O_3.11Al_2O_3$" to -- $REM_2O_3 \cdot 11Al_2O_3$ --;

Column 14, line 58, change "$REM_2O_3.11Al_2O_3$" to -- $REM_2O_3 \cdot 11Al_2O_3$ --;

Column 14, line 63, change "$REM_2O3.11Al_2O_3$ and $REM_2O_3.Al_2O_3$" to -- $REM_2O3 \cdot 11Al_2O_3$ and $REM_2O_3 \cdot Al_2O_3$ --;

Column 14, line 67, change "$REM_2O_3.11Al_2O_3$" to -- $REM_2O_3 \cdot 11Al_2O_3$ --;

Column 15, line 40, change "the amount of is" to -- the amount of Cu is --;

Signed and Sealed this
Sixteenth Day of February, 2016

Michelle K. Lee

Michelle K. Lee
*Director of the United States Patent and Trademark Office*

In the specification

Column 16, line 60, change “Ti-included-carbo nitrides” to -- Ti-included-carbonitrides --;

Column 17, line 16, change “0.0040% or less of 0;” to -- 0.0040% or less of O; --;

Column 17, line 18, change “respective element the chemical” to -- respective element in the chemical --;

Column 17, line 54, change “treatment the converter” to -- treatment in the converter --;

Column 18, line 27, change “continuously cast order” to -- continuously cast in order --;

Column 18, line 40, change “the roiling reduction may be 0%, that is, the hot roiling may be” to -- the rolling reduction may be 0%, that is, the hot rolling may be --;

Column 19, line 1, change “Then, Cu was added” to -- Then, Ca was added --;

Column 19, line 10, change “a Ca-Si alloy added to” to -- a Ca-Si alloy was added to --;

Column 19, line 49, change “carbonitrides be” to -- carbonitrides may be --;

Column 19, line 64, change “and a case of 1 pieces/$mm^2$” to -- and a case of more than 1 pieces/$mm^2$ --; and Column 20, line 58, change “results are show” to -- results are shown in --.